US005909777A

United States Patent [19]

Jamison

[11] Patent Number: 5,909,777

[45] Date of Patent: Jun. 8, 1999

[54] METHOD AND APPARATUS FOR STOPPING THE SPREAD OF A FIRE IN AN UNDERGROUND MINE

[75] Inventor: Will B. Jamison, McMurray, Pa.

[73] Assignee: Jamison Family Trust, McMurray, Pa.

[21] Appl. No.: 08/961,686

[22] Filed: Oct. 31, 1997

Related U.S. Application Data

[63] Continuation-in-part of application No. 08/747,449, Nov. 12, 1996, abandoned.

[51] Int. Cl.[6] ..... A62C 2/08

[52] U.S. Cl. ..... 169/43; 169/64

[58] Field of Search ..... 169/43, 45, 46, 169/47, 48, 64

[56] References Cited

U.S. PATENT DOCUMENTS

| | | | |
|---|---|---|---|
| 924,599 | 6/1909 | Byers | 169/46 |
| 1,191,643 | 7/1916 | Wilson et al. | 239/536 |
| 1,282,142 | 10/1918 | Thompson | 239/722 |
| 1,368,269 | 2/1921 | Lemke | 239/723 |
| 2,747,933 | 5/1956 | Voigt | 239/240 |
| 2,769,664 | 11/1956 | Cornelius | 239/726 |
| 3,684,021 | 8/1972 | Poitras | 169/47 |
| 3,807,635 | 4/1974 | Platt | 239/726 |

*Primary Examiner*—Andrew C. Pike
*Attorney, Agent, or Firm*—Price & Adams

[57] ABSTRACT

An assembled length of water pipe sections having a nozzle pipe section at an inby end is moved from a crosscut of a mine into a mine entry to stop the advance of a fire in the entry without requiring firefighters to be positioned in the fire entry. The nozzle pipe section is moved across the entry to a position adjacent to an opposite entry sidewall. The nozzle pipe section is connected at an outby end in the crosscut by assembled sections of extension water pipes to a water feedline. Water under pressure is supplied through the extension pipes to the nozzle pipe section and discharged from the nozzles to generate a series of intersecting sprays directed at selected angles in a range between about 0° to 90° in the entry, forming a water curtain the complete height and width of the entry. Deflected water sprays from the sidewalls and mine roof combine with the upward water sprays to form a curtain of water extending across the path of the advancing fire and into contact with roof bolts supporting the mine roof above the entry. The water spray prevents the roof bolts from being heated to an elevated temperature which can cause a loss of anchorage of the bolts in the mine roof. The water curtain also cools the hot gases generated by the fire to stop advance of the fire beyond the curtain so that the fire can be contained and extinguished.

27 Claims, 14 Drawing Sheets

METHOD AND APPARATUS FOR STOPPING THE SPREAD OF A FIRE IN AN UNDERGROUND MINE

CROSS REFERENCE TO RELATED APPLICATION

This application is a continuation-in-part of application Ser. No. 747,449 filed Nov. 12, 1996, entitled "Method and Apparatus for Stopping the Spread of a Fire in an Underground Mine", abandoned.

BACKGROUND OF THE INVENTION

1. Field of the Invention

This invention relates to fire extinguishing apparatus and, more particularly, to a water curtain method and apparatus for stopping the spread of a fire and for extinguishing the fire in an underground coal mine.

2. Description of the Prior Art

Coal is mined because it will burn and, therefore, is a major source of economical energy. In 1994 a little over one billion tons of coal were mined in the United States. Coal was the energy source for over 55% of the electrical energy generated in this country during 1994.

Unfortunately fires can and do occur in underground coal mines. These fires are a threat to the lives of the miners. Fires can cause great financial loss to the mining companies. According to the Mining Safety and Health Administration, there were 271 reportable fires in underground coal mines in the United States during the ten year period from Jan. 1, 1978 through Dec. 31, 1987. Fortunately most of these fires were handled promptly so the losses were small, but some were not.

The December 1984 fire at the Wilburg Mine near Huntington, Utah was especially tragic because it killed 27 miners. The cost of this fire has been variously estimated to have been in excess of 50 million dollars. The 1987 fire at Cumberland Mine of United States Steel Co. closed the mine for many months. It was reported that the cost of fighting the fire and restoring the mine to operation was about 13.5 million dollars. The fire during March of 1988 at the Beth Energy No. 58 Mine near Marianna, Pa. resulted in the total loss of the mine. Bethlehem Steel Co. wrote off 45 million dollars.

This listing of three very serious fires is far from complete, but they do fit the experience of the past. Most fires in coal mines follow a similar pattern. Usually, the start of a fire is small and can be controlled with a fire extinguisher, if it is used soon enough. Today's coal mines are spread over very large areas and much of the area is unattended so a fire may not be discovered promptly. If the fire has enough time to spread to the coal, then the fire has become a mine fire and the fuel for a mine fire is virtually without limit.

Burning coal can be effectively and quickly controlled with water applied as a fire hose stream. If the fire is not discovered quickly or if the fire fighting was not started in good time, this may not work. Fire hose streams have limited range in the restricted height of a mine. The fire almost always takes the course that the ventilation follows. It can only be approached from the upwind side. The downwind side of a fire that has spread to the coal is full of smoke and very hot.

The heat of a mine fire weakens the mine roof and may cause caving. Falls of the roof can prevent the fire hose streams from reaching the fire extending beyond. Also, the firefighters must support the weakened roof as they advance into the area where they have extinguished the fire with their hose streams. Supporting the weakened roof to make it safe is slow, difficult work. Usually the firefighters cannot follow a fire as fast as it moves with the ventilation air. A fire cannot be controlled with fire hose streams when the water does not reach all of the fire.

At this point it may be useful to explain some of the basic fundamentals of coal mining so that persons who have never been in a mine will have a better understanding of the problems of controlling a fire. All underground mines (not just coal mines) must have moving fresh air so that the miners can work. The mining of coal almost always releases methane gas from the coal seam. Breaking the coal from the seam, which really is the mining operation, may release combustible methane gas. Air movement or ventilation is required to dilute the methane to a safe noncombustible concentration and carry the methane-air mix to the surface.

The coal mine is ventilated with "intake air" through a network of "entries" or tunnels in the coal seam. When the intake air reaches the "face" where the actual mining takes place and dilutes and carries away the methane, the air is then called "return air". Return air is directed into "returns" or "return entries" which conduct the return air to the surface.

The return air is not allowed to contact equipment that might ignite a methane-air mix. The only equipment allowed in the face area and in a return must be "permissible" which means that it has been tested and found to be flameproof. Equipment that will be used only in intake entries does not have to be permissible, but much of the electrical equipment will be dusttight.

It should be apparent that in mining or developing entries, there must be at least two entries, an intake and a return, which must have ventilation. Also, in the production area or "section" where the actual mining is taking place there must be connections for the air to flow between the intakes and the returns. These connecting entries are called "crosscuts".

Crosscuts are usually spaced about every 100 feet. When the entries have advanced about 100 feet beyond a crosscut, the next crosscut will be started. When this crosscut is finished, the one behind will be closed to ventilation, eventually with a concrete block or metal wall called a "stopping". In actual practice, there are almost always three or more entries in a section, usually about 100 feet apart, driven with crosscuts between entries.

Modern coal mines can be classified by the mining system used to extract the coal. Virtually all coal mines use powerful "continuous miners" to drive openings in the coal seam.

These machines break the solid coal into pieces so that it can be hauled and/or conveyed to the surface. The openings made are the entries and crosscuts referred to above. Two of the most used mining systems are the longwall mining system and the block or room and pillar system.

Development, or the driving of entries and crosscuts, for the longwall system usually requires driving 4, 3, or sometimes only 2 entries with the necessary crosscuts between these entries. Since the entries have different functions and ventilation, usually all of the crosscuts between the entries will be sealed with stoppings to prevent the ventilation air currents from flowing from one entry to its adjacent entry, unless this is needed. These stoppings are effective barriers to a fire in one of the entries and will prevent the fire from spreading to the adjacent entry, at least for a reasonable time.

In contrast, the block system involves driving a larger number of parallel entries, often 8 or 10 and sometimes even more. With this multiplicity of entries, many will remain connected through open crosscuts and will share the ventilation. A fire in one of the connected entries will tend to stay in the originating entry as it will follow the ventilation, but with the expansion of the hot gases that have gone through the fire zone, the heat and smoke can move into adjacent open entries. Usually it is just a matter of time until the active fire will spread to adjacent entries, unless steps are taken to prevent this spread.

Current federal regulations require a mandoor in a line of stoppings at least every 500 feet. Regulations also require that entries for a conveyor belt, trolley haulage, and intake escapeway, with their ventilation, be separated by stoppings. Also, since many mines must leave pillars of coal to support the surface, all of the mining will involve the "driving" of entries and crosscuts. Where pillars can be removed and the surface lowered, many different arrangements of entries may be used to provide support of the strata over the entries needed for ventilation, travel, and production.

Other regulations require water hydrants at least every 300 feet in a belt entry. Usually this results in having the water line, that also supplies water to allay the dust made by the mining equipment on producing sections, located in the belt entry. Sufficient fire hose must be located on each section to be able to reach from the last hydrant at the end of the water line to the most distant point on the section. Also, fire hose must be located near the drive of the conveyor belts. Regulations also require fire protection systems near each belt drive to cover at least 50 feet of the belt drive area and a fire detection system for the length of each belt.

The record of fires clearly shows that the federal regulations have not eliminated the hazards of mine fires and losses of life and/or property resulting. The problems in coal mining are especially severe because the environment is almost 100% combustible.

The statistics of fires in underground coal mines are obviously inadequate as only fires that have existed for 30 minutes or more must be reported. However, discussions with safety managers have disclosed that most of them believe that a large percentage of the incipient fires that do occur are extinguished by the personnel present in less than 30 minutes. Estimates given in these discussions vary widely with many saying that 70 to 90 percent of the fires are handled quickly so no reporting was required.

Many reports of fires which did burn well over 30 minutes describe scenarios of the fire getting beyond the range of the fire hose streams. Prior to 1960 virtually all of these fires had to be sealed. Sealing is very expensive as the mine must remain sealed, often for four to six months, to allow the heat of the fire to cool and avoid rekindling when ventilation is restored in the fire area. In a 1960 fire the new tool of high expansion foam, conceived in Great Britain and developed and tested in the United States, controlled a fire that had spread over an area so that 4100 lineal feet of entries and crosscuts were burning. The foam equipment operated almost continuously for three days. This fire probably was the largest mine fire that was ever controlled by direct fire fighting.

Unfortunately only about 60 of the large high expansion foam generators similar to the one used on the above described fire have been purchased by the coal industry. They are not inexpensive as the current price for the generators, which must be tailor made for the mine, is in the order of thirty to forty-five thousand dollars. Many smaller and less refined generators are commercially available. Based on the fire reports available in the United States, these smaller and less expensive machines have never been successful in controlling a fire that spread to the coal. The result has been that some fires were not fought successfully using this advanced firefighting technique because the foam equipment was unavailable, inadequate, or mishandled.

It is also important to consider the manner in which nonreportable fires have been controlled and also why these techniques have failed in other instances. Because quick response to a fire is so important, virtually all fires that are extinguished are fought by persons who were at or in the vicinity of the fire when it started. If extinguishers are used quickly enough, they can extinguish the fire while it is still small. When the fire spreads to the coal, a fire hose stream can extinguish the fire if it has not spread beyond the range of the hose streams. The rate at which the fire will spread to the coal is greatly affected by the size of the starting fire, the height of the coal seam, the presence of a coal top or "roof", and the percent volatile of the coal.

Fires seldom get out of control in low seam mines, which usually have noncombustible roof. If the volatile content of the coal is low, the coal will not ignite readily and the rate a fire will spread is slow. These conditions which slow the spread of the fire provide more time to assemble the personnel and equipment needed to fight the fire. The advance of the firefighters is usually fast enough so that they can overtake the leading edge of the fire and extinguish it.

In contrast, the opposite will occur in coal mines having thick seams with high volatile coal, especially at the mine roof. The coal ignites readily, and the fire grows and moves downwind rapidly. This fire situation must be handled very quickly and competently with fire hoses before it gets beyond the range of a hose stream.

Since the maximum range of a fire hose adjusted to a solid stream in high coal is in the order of 40 to 50 feet, the fire will be large before it gets away from the fire hose streams. Because the fire is large and active, the downwind side of the fire is very hot with dense smoke. In the past attempts have been made to set a fire hose in a crosscut on the downwind side of the fire close to the entry to stop the fire, but the published fire reports indicate that these attempts have not been successful in difficult fire situations.

It is important to understand the conditions that make it difficult to fight fires in a coal mine. The amount of air that reaches the upwind side of the fire is the amount needed to provide safe conditions for the firefighters who are using the fire hoses. Usually, the ventilation air velocity must be in the order of 200 to 300 feet per minute (fpm) to prevent the smoke from the fire from moving back against this fresh air. Higher velocity will feed the fire and cause it to grow rapidly. Air velocity of 200 to 300 fpm is sufficient to feed a large fire.

In passing through the fire area, much of the oxygen is used by the fire and turned into gaseous products of combustion including smoke and heat. Usually the temperature on the downwind side of the fire is in excess of 1000° F. (538° C.). This temperature is enough to cause the gases to expand to almost three times (or more if the temperature is higher) the original air volume. Steam from the water reaching the fire may tend to keep the temperature down but it adds to the downwind volume. So the velocity of the gases leaving the active fire area can be three or more times the velocity of the fresh air on the upwind side of the fire.

In addition to the smoke and heat on the downwind side, the velocity can be 600 fpm or more. Velocities of this magnitude are not usually encountered by professional firemen wearing special heat protective gear. In view of these factors combined with the lack of professional firefighting equipment, the known methods for fighting an underground mine fire from the downwind side of the fire have not been successful.

In the text Mine Fires by Donald W. Mitchell, published 1990, on page 3 it states "one of the first critical steps when fighting fire in a mine is to SPRAY WATER (preferably as fog) INTO THE PATH OF (as close as possible to) THE ONCOMING FLAMES. The sooner this is done, the greater the chance for success." Unfortunately the Mitchell text does not tell how to put this water spray "into the path of the oncoming flames" but suggests that this be accomplished before the fire gets very large. The Mitchell text does not make reference to any successful uses of the disclosed technique and a search of the more current literature on this subject does not include any record that this firefighting technique has been successfully practiced.

Some mines have prepared lances with a nozzle attached to the end of a 20-foot long length of pipe. These have been used with some success in attacking fires on the upwind side when falls of the roof strata interfere with fire hose streams being directed at the fire which has spread beyond the fall. The lance can be laid on the top of the fall or in a crack of the fall and be pushed further into the fire area. Since the length of pipe that can be pushed over or through a fall is limited, a lance applied from the upwind side of a fire can only be effective on a fire that has not spread very far.

Consideration has been given to the use of lances on the downwind side of a fire. The plan of use for a lance is to make a small hole near the top of the stopping in the crosscut inby the fire and insert the lance and push it as far as possible to get close to the entry. In practice, there are two very difficult related problems with this scheme. First, virtually every mine has the line of stoppings in the crosscuts connecting with the entry containing the belt conveyor at some distance from the belt entry. So the usual distance from the stopping to the belt entry is about 50 to 70 feet. The reason for the stopping being closer to the other end of the crosscut is that it is easier and less disruptive of coal production if the material (usually concrete blocks) to build the stopping is delivered through the entry away from the belt entry. The stopping which must be built by hand is built close to where the material is delivered at the other end of the crosscut.

Second, since the lance must be cantilevered from the stopping, about the greatest distance that it is possible to do this with 1½- or 2-inch pipe is one pipe length or 20 feet. The use of lances generally do not work in the most serious fire risk, a belt fire, which consistently causes more fires than any other. Similar to the scheme of stopping a fire as described above, there are no records of successfully using lances in stopping the spread of a fire on the downwind side of a fire. It is believed that this firefighting technique might be successful if the stopping were sufficiently close to the entry involved.

U.S. Pat. No. 3,684,021 discloses apparatus for detecting and suppressing a potentially dangerous flame from moving away from a mine face and down a mine tunnel. A flame extinguishing agent is not discharged upon the occurrence of ignition of small pockets of either methane or coal dust adjacent the mine face. As a rule most of the flames ignited adjacent the mine face terminate quickly or are extinguished by water from spray equipment mounted on the mining machine for suppressing dust and maintaining the cutter bits cool during the material dislodging operation.

As disclosed in U.S. Pat. No. 3,684,021 once the flame progresses from the mine face and advances in the entry where it begins to be fueled by ventilation air, the advancing flame is detected. A flame suppressing agent is then discharged ahead of the advancing flame. The agent completely fills the cross-sectional opening of the entry. When the flame reaches the area of the entry filled with the extinguishing agent, the flame is quenched and prevented from igniting an explosive mixture of airborne coal dust and/or methane gas.

U.S. Pat. No. 924,599 also discloses a method of extinguishing fires in a mine by sealing off the advancing flame. Upon the occurrence of a fire, the entrance to a heading is sealed by closing a door and a network of pipes are opened to the entry. An exhaust pump is connected to the network of pipes so that air is drawn out of the entry into the pipes. Consequently the atmospheric pressure in the sealed entry is reduced. The air normally supporting combustion is withdrawn and the fire is extinguished. The network of pipes can also be used to introduce steam to the entry to contribute to the fire suppression.

While it has been proposed to attach a nozzle or spray head to the outlet end of fire hose or pipe and advance the pipe outlet into a confined structure to flood the structure with water to suppress the flame, the known devices, as disclosed in U.S. Pat. No. 2,747,933, are not adaptable for use in fighting fires in an underground mine. It is also known to mount pipes or conduits on wheels to move the conduits to a desired position where water is sprayed from nozzles spaced along the length of the mobile pipe. These types of devices are most commonly utilized in lawn sprinkling systems as disclosed in U.S. Pat. Nos. 1,191,643; 1,282,142; 1,368,269; and 3,807,635.

U.S. Pat. No. 2,769,664 discloses a mobile sprinkler-type irrigation system. This system permits water to be conveyed through a network of pipes to a distance point where water is dispersed in a spray pattern from spaced-apart nozzles. The systems are not adaptable for use in an underground mine to suppress a fire.

While it is not possible to be certain that the methods or equipment disclosed in the above patents have ever been tried or used in coal mines, it can be stated safely that they are not in use now.

An obvious method that would virtually eliminate all risk of fires would be to install automatic sprinklers throughout the mine as the entries and crosscuts are being mined. However, the magnitude and cost of such an installation would be prohibitive.

As previously noted federal coal mine regulations require installed fire protection for only fifty feet of the mine opening containing the drive machinery of each belt conveyor. This regulation is aimed at the most serious fire risk areas in the mine. The regulation recognizes that built-in fire protection can only be justified for the most serious fire risks.

There is need to provide a method using simple equipment for creating a water barrier or curtain of water spray that continuously wets the roof and ribs of the mine entry on fire and to cool the hot gases of the fire so that the fire will not advance downwind. This must be accomplished without exposing any firefighters to the hot gases or smoke. By spraying water against the roof and with the pattern being wide enough to wet the ribs, these surfaces should be kept wet so that the flames and heat from the burning coal upwind will be unable to advance onto the wet coal. With ample water wetting the roof, the excess will drop back to the bottom of the entry resulting in further cooling of the hot gases and wetting of the bottom and any objects such as a conveyor belt in the entry.

Therefore, there is need for firefighting equipment capable of stopping a mine fire on the downwind side with a continuous application of water. With this method, the fire will not be able to continue to spread downwind. With the spread of the fire halted, there will be ample time for the firefighters to extinguish the fire using fire hoses in the fresh air on the upwind side of the fire.

SUMMARY OF THE INVENTION

In accordance with the present invention, there is provided apparatus for stopping spread of a fire in an underground mine that includes a pipe assembly formed of connected pipe sections of preselected lengths for positioning in the underground excavation. The pipe assembly has inby and outby opposite end portions. The pipe assembly is supported for movement of the inby end portion on the floor of the mine to a preselected position therein. The pipe assembly at the outby end portion is connected to a source of water under pressure to be supplied to the pipe assembly. The pipe assembly inby end portion is a nozzle pipe section having a plurality of outlets extending through a top surface thereof. The outlets are positioned in spaced relation on the nozzle pipe section. A plurality of spray nozzles are connected to the outlets for receiving pressurized water flowing through the pipe assembly to the nozzle pipe section and discharging the water in a spray pattern therefrom. The spray nozzles generate a patterned spray of water projecting upwardly from the nozzle pipe section to form a curtain of water in a preselected orientation to prevent a fire in the underground mine from spreading beyond the curtain of water.

Further in accordance with the present invention, there is provided a method for stopping the spread of a fire in an underground excavation that includes the steps of advancing a preselected length of a nozzle pipe along a floor of the mine to a preselected position therein. Spray nozzles are connected to a plurality of outlets positioned in spaced relation on a section of the nozzle pipe and extending through the top of the nozzle pipe assembly. Water is supplied under pressure through the nozzle pipe. A flow of water under pressure is directed from the nozzle pipe through the outlets to the spray nozzles. Water under pressure is discharged in a spray pattern from the spray nozzles. The spray pattern of water is cast upwardly from the nozzle pipe to form a curtain of water along the length of the nozzle pipe in a preselected orientation. A fire is prevented from spreading in the underground excavation beyond the curtain of water.

In addition the present invention is directed to underground mine fire extinguishing equipment that includes an assembled length of pipe sections having inby and outby opposite end portions. The inby end portion includes a nozzle pipe section having a plurality of spray nozzles connected thereto in spaced relation along the length of the nozzle pipe section. The inby end portion is mounted for movement of the nozzle pipe section to a position extending across an entry of the mine. The spray nozzles generate a curtain of water directed upwardly from the nozzle pipe section into contact with a mine roof and opposing sidewalls of the mine entry to stop the spread of a fire in the mine entry beyond the curtain of water.

Accordingly, a principal object of the present invention is to provide a method and apparatus to prevent the spread of a fire in a coal mine by assembling a series of connected pipes having at the inby end a nozzle pipe with a selected arrangement of nozzles and the outby end coupled to a hose through which pressurized water is delivered to discharge water from the nozzles in a continuous spray pattern creating a water curtain or barrier the full width and height of the mine opening that the fire cannot penetrate.

Another object of the present invention is to provide a method for creating a spray of water ahead of a fire moving through a mine entry where the firefighting equipment is assembled and moved into position from a location where the firefighters are not endangered by the fire.

An additional object of the present invention is to provide a method for fighting fires in underground mine entry by moving a portion of a nozzle pipe assembly through an opening in a stopping that seals the crosscut preventing access to the entry and positioning the nozzle pipe assembly so that it can generate a water barrier or curtain across the path of the advancing fire to stop the advance of the fire so that it may be contained and extinguished in the entry.

Another object of the present invention is to provide an assembly of connected pipes movable into a mine entry from a remote location with nozzles mounted on a pipe section to spray water onto the walls and roof of the entry to form a barrier that stops the fire from advancing in the entry.

These and other objects of the present invention will be more completely disclosed and described in the following specification, the accompanying drawings, and the appended claims.

DESCRIPTION OF THE PREFERRED EMBODIMENTS

Figure 1:
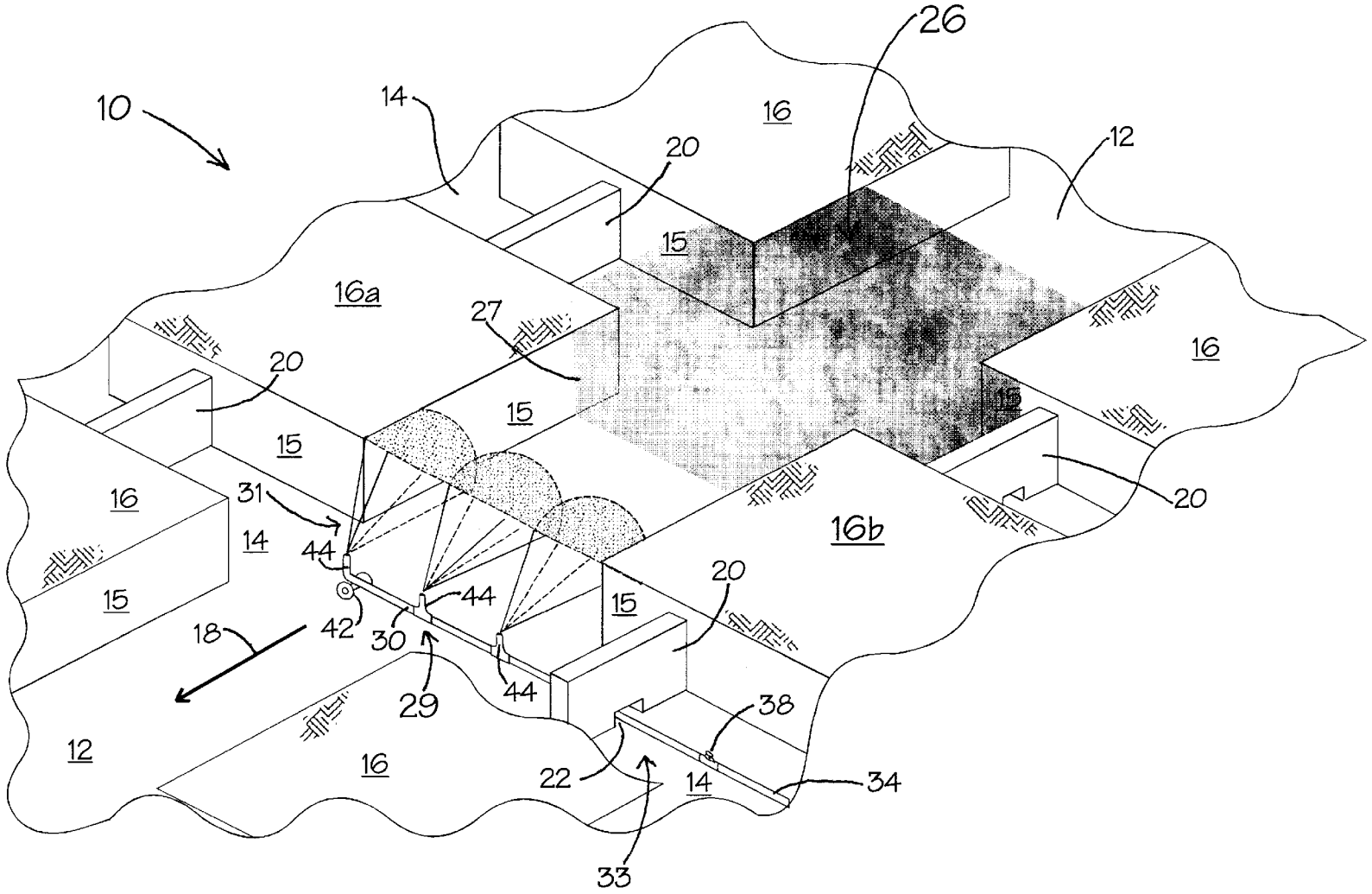
FIG. 1 is a fragmentary isometric view of a portion of an underground mine layout, schematically illustrating a fire advancing in an entry toward a water curtain developed by a series of spray nozzles supported by a pipe extending from a crosscut across the path of the advancing fire.
Figure 2:
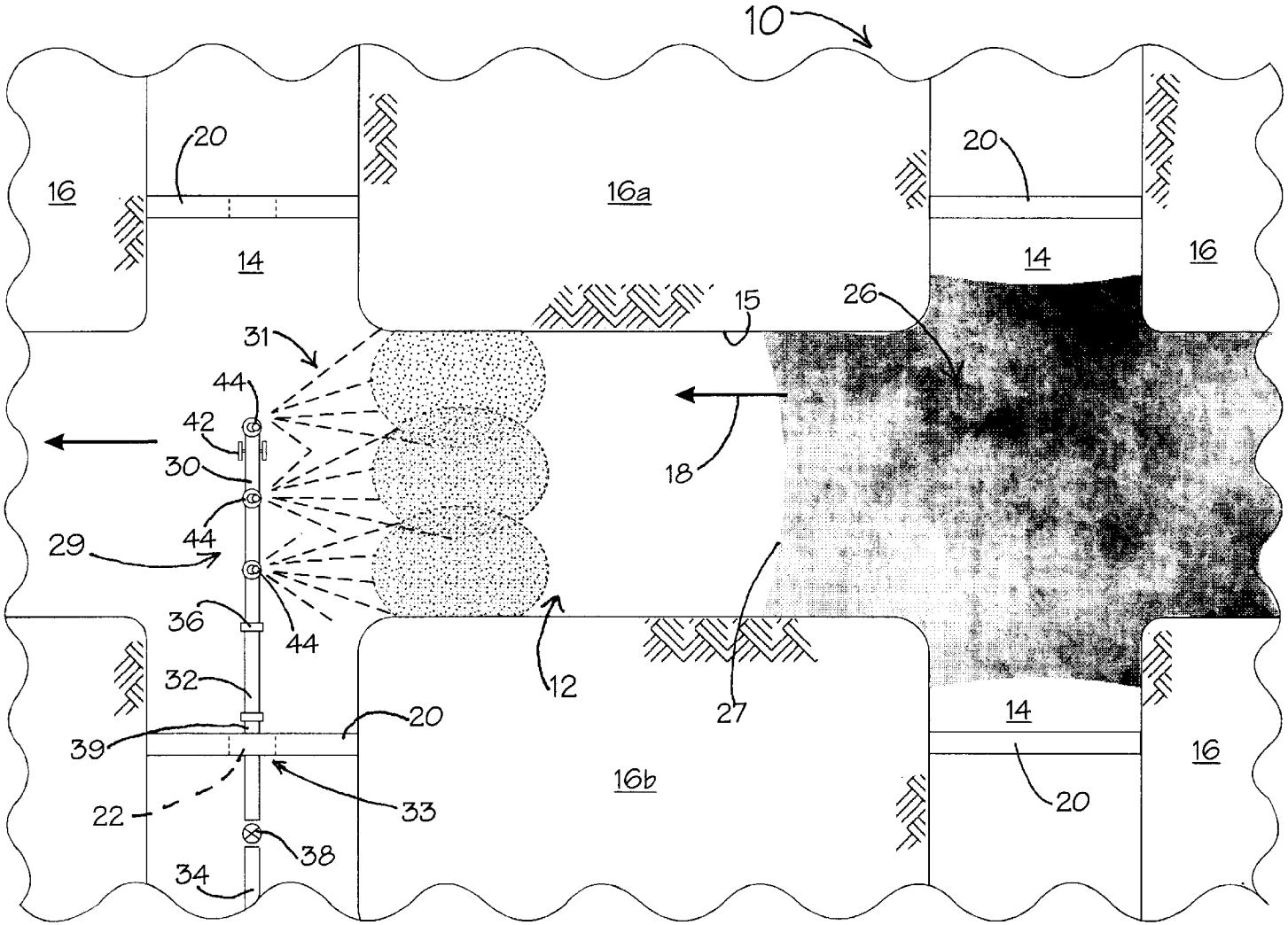
FIG. 2 is a plan view of the mine layout shown in FIG. 1, schematically illustrating the fire advancing in the entry toward the water barrier formed by water sprays from the pipe extending from the crosscut into the entry.

Referring to the drawings and particularly to FIGS. 1 and 2, there is illustrated a portion of an underground coal seam 10. An entry generally designated by the number 12 is cut in the coal seam 10 by conventional mining methods. In the mining of coal, a series of parallel entries 12 are driven with conventional mining machines, such as continuous miners, and the coal produced is transported or conveyed to the surface. The usually parallel entries are connected by a series of usually parallel crosscuts 14 driven with the same equipment. The entries 12 and the crosscuts 14 are spaced preselected distances apart forming pillars 16, 16*a*, and 16*b* of unmined coal to support the strata above the coal seam.

Figure 3:
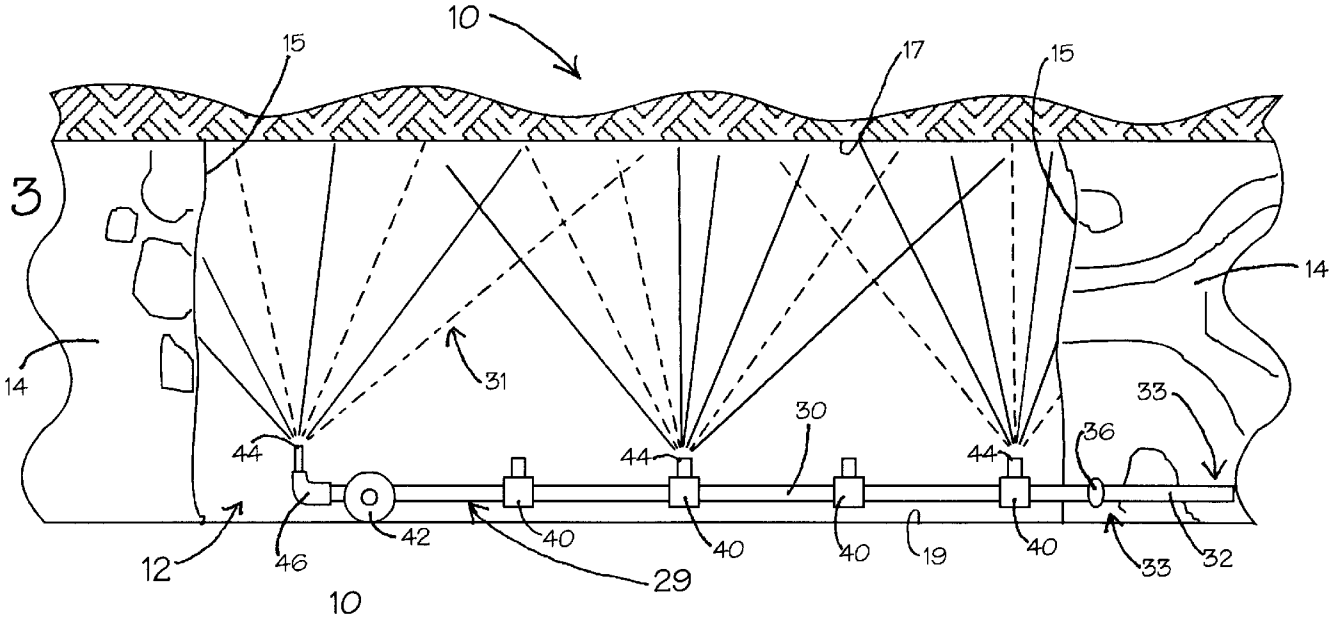
FIG. 3 is a schematic fragmentary elevational view of a mine entry, illustrating a nozzle pipe section with nozzles positioned in the entry and generating a water barrier the full height and width of the mine entry.
Figure 4:
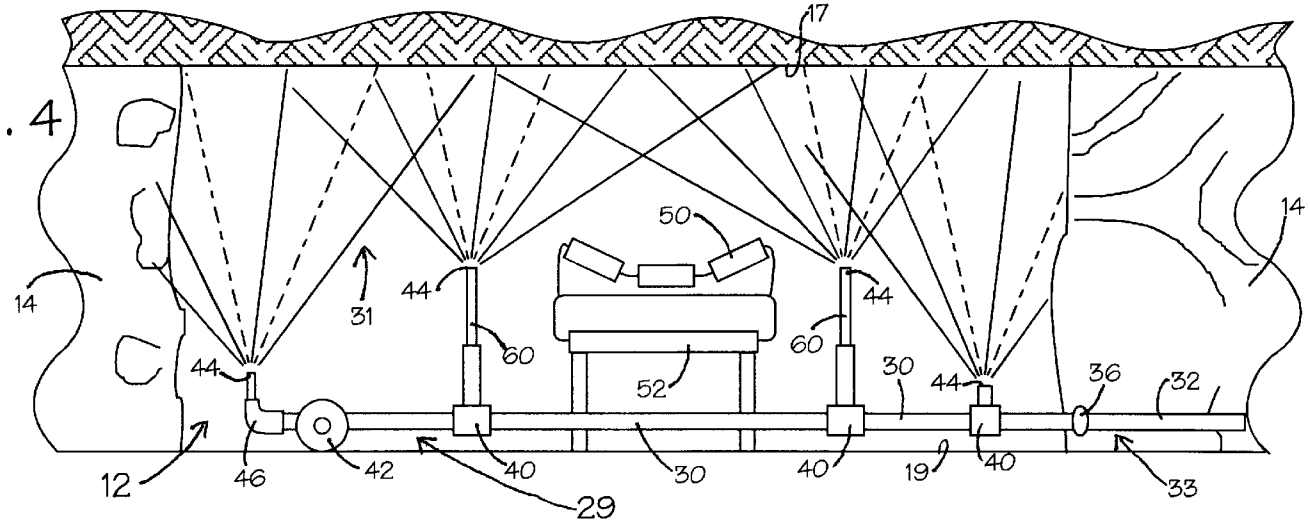
FIG. 4 is a view similar to FIG. 3, illustrating a conveyor positioned in the entry and nozzles of the pipe arranged to discharge a stream of water up and over the conveyor to form the water barrier across the entry.

As shown on FIGS. 3 and 4, each entry 12 and crosscut 14 is defined by sidewalls or ribs 15. A roof 17 extends over and across the entries 12 and crosscuts 14. The roof 17 is usually reinforced by conventional roof support systems (not shown). A mine floor 19 is formed at the base of the entries 12 and crosscuts 14. With this arrangement operating personnel, equipment, and mined material are moved and transported in the mine through the entries 12 and crosscuts 14.

As required by conventional ventilation practice and/or regulations, certain crosscuts 14 are sealed against air flow by the use of stoppings 20, as shown in FIGS. 1 and 2, which are walls or barriers of concrete blocks or metal panels. To permit access between entries, man doors in the stoppings 20 are required at intervals of not over 500 feet apart. Man doors are located usually in only one of every five stoppings 20. The man doors are not shown in FIGS. 1 or 2.

With the more likely situation of the stopping 20 being solid, FIG. 1 illustrates an opening 22 in the stopping 20 of sufficient size to allow a nozzle pipe section 30 mounted on a wheel unit 42 and connected to a coupled assembly of pipes 32 to be inserted and pushed into position. The wheel unit 42 is constructed to meet the floor conditions of the mine. Preferably the wheel unit 42 is designed to traverse a conventional mine floor formed by the rock formation. Another embodiment with larger wheels is designed to negotiate movement over rail haulage tracks on the mine floor. In the latter case the wheel unit 42 must be large enough to permit the nozzle pipe section 30 to be pushed across the tracks and advanced to the desired position in the entry. In a further embodiment shown in FIG. 20, the wheel unit 42 is provided with flanged wheels operable to move on the rails of a face conveyor of a longwall mining machine to permit use of the present invention in stopping a fire originating on a longwall face. Also, within the scope of the present invention, the nozzle pipe section 30 is mounted on any type of transport mechanism that facilitates selective positioning of the nozzle pipe section 30 in the mine entry 12.

The directional arrows 18 in the entry 12, shown in FIGS. 1 and 2, indicate the direction of the ventilation air in the entry. The extent of an active fire 26 and the location of its leading edge 27 on the downwind side is shown on FIG. 2. The major growth of the fire 26 is on leading edge 27 as the fire follows the course of the ventilation air (directional arrow 18) until it reaches a water curtain generally designated by the numeral 31 created by nozzles 44 of the nozzle pipe section 30 in accordance with the present invention.

Figure 10:
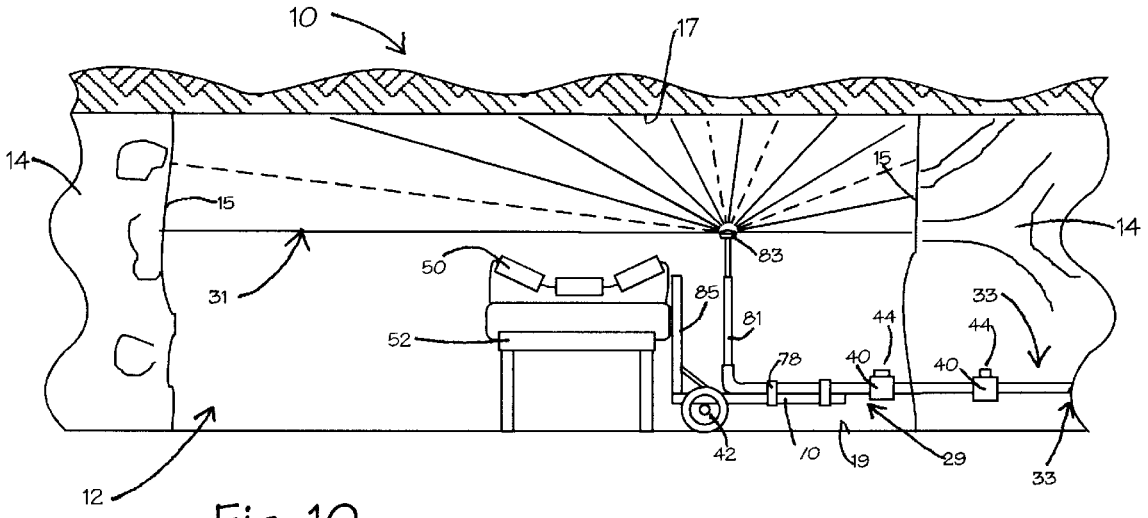
FIG. 10 is a view similar to FIG. 4, illustrating the nozzle pipe shown in FIG. 9 abutting a conveyor in the entry with the nozzles positioned on the pipe to cast a water barrier spray over the conveyor to the opposite sidewall.

FIG. 3 shows very clearly the simplicity of using the nozzle pipe section 30 in an open entry where there are no obstructions to the discharge pattern of a plurality of nozzles 44 and associated tee connections 40. Further, a 90° nozzle assembly 46 is threadingly secured to the inby end of the nozzle pipe section 30. Nozzle assembly 46 includes a nozzle 44 for discharging a preselected spray pattern. In one embodiment, the nozzle pipe section 30 has two unused tee connections 40 located on the pipe. The nozzle pipe section 30 may utilize a considerable number of tee connections 40 so that a wide variety of nozzles 44 and/or telescoping mounts 60, shown in FIG. 6, or hinged mounts 62, shown in FIG. 7, can be used. Also tee connections 40 are used to mount additional nozzles inclined to provide sprays over the top of a belt 50 and its structure 52, as shown in FIGS. 4 and 10. By keeping mine roof 17 over the belt wet with an excess of water, the excess water will fall back down onto the belt like rain preventing the fire from spreading downwind on the combustible belt.

A wide range of variable conditions can exist between coal mines and also within the same mine. For example, the height of the entries vary. To obtain an effective water curtain the cast of the spray pattern of the nozzles 44 may have to be wider where the height is less and the angle of the spray adjusted, or more nozzles may be required. The angle of the water spray generated by the nozzles is preferably adjustable in a range of angles between about 0° to 90°. The available water pressures vary; therefore, the orifice size of the nozzles may need to be larger if the pressure is low.

Typically full line nozzle manufacturers supply a wide range of nozzles and accessories suitable for use in the present invention. Full cone and hollow cone nozzles of different sizes and different cone angles are commercially available. Preferably a nozzle is used that can pass relatively large solid particles that would plug most standard nozzles. Among the important accessories available are adjustable ball fittings, having a wide range of angular adjustment, that allow more exact aiming of the nozzles on the nozzle pipe section 30.

FIGS. 1 and 2 show an outby end 33 of the connected extension pipes 32 extending approximately on the centerline of the crosscuts 14 into the entry 12 with the nozzles at the inby end tilted or pivoted on the nozzle pipe section 30 to form the water curtain 31 close to the upwind side of the crosscuts. This prevents the advancing fire from following the ribs 15 around the corners of the blocks 16*a* and 16*b* and into the crosscuts.

If the nozzle pipe section 30 were close to the center of the crosscuts and the nozzles were directed vertically up, then the corners of the pillars probably would not be wetted. This is remedied by using adjustable ball fittings, 45° or 90° elbows, bent pipes, or a combination of these between the nozzles 44 and tee connections 40 in the nozzle pipe section 30 to direct the spray discharge at the roof at an angle so as to carry into the entry toward the fire 26. This will keep the roof and the corners of the pillars 16*a* and 16*b* wet so the fire can not get around the water curtain.

Figure 7:
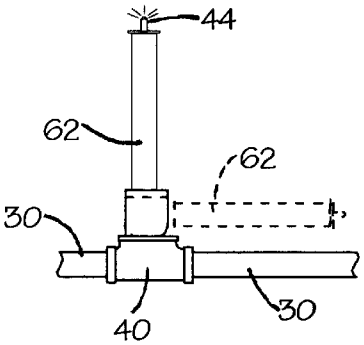
FIG. 7 is a view similar to FIG. 6, illustrating an elevated nozzle supported by a hinged mount that is pivoted from a horizontal position, either manually or by the use of a spring, which is not shown. A cable operated latch (not shown) permits the hinged mount to move to its vertical position.
Figure 6:
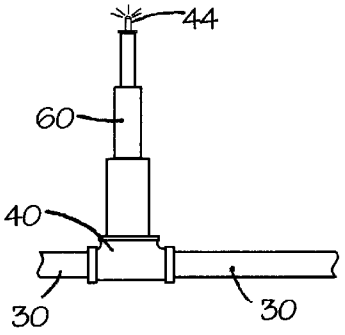
FIG. 6 is a schematic view in side elevation of a section of the water pipe, illustrating a nozzle that is attached to the top of a telescoping section that raises the nozzle to an elevated position when the water flow starts.

Since the inby end 29 of the nozzle pipe section 30 is introduced into the entry on the downwind side of the fire where very hot gases move at high velocity, all of the pipe and other fittings should be made of steel or stainless steel. Brass melts at temperatures close to 1000° F. and should not be used. Water flow may be used to keep the nozzle pipe section 30, as shown in FIG. 3, and its components cool during final movement into position. The arrangements using components shown in FIGS. 6 and 7 are raised into position by the water pressure so that the nozzle pipe section 30 can be properly positioned. Also, it should be understood that firefighters will not be able to see the inby end 29 of the nozzle pipe section 30 and the extension pipes 32 being assembled and pushed toward and finally into the entry 12 because of the smoke. They may find that the end of the nozzles pipe 30 encounters some obstruction such as the leg supports of a belt structure 52 shown in FIGS. 4 and 10. It may be partially withdrawn and reaimed to attempt to reposition to miss the obstruction or stopped at the obstruction as shown in FIG. 10.

Figure 5:
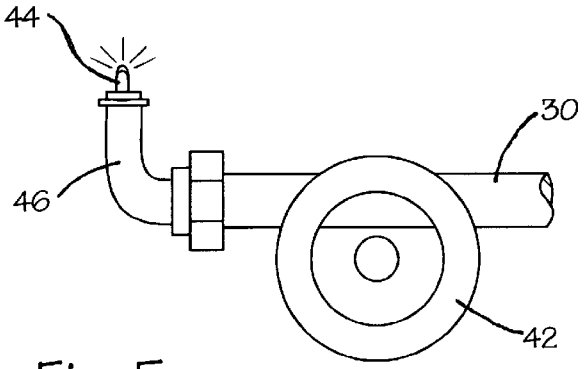
FIG. 5 is a schematic fragmentary elevational view of a wheel mounted end of the nozzle pipe.
Figure 23:
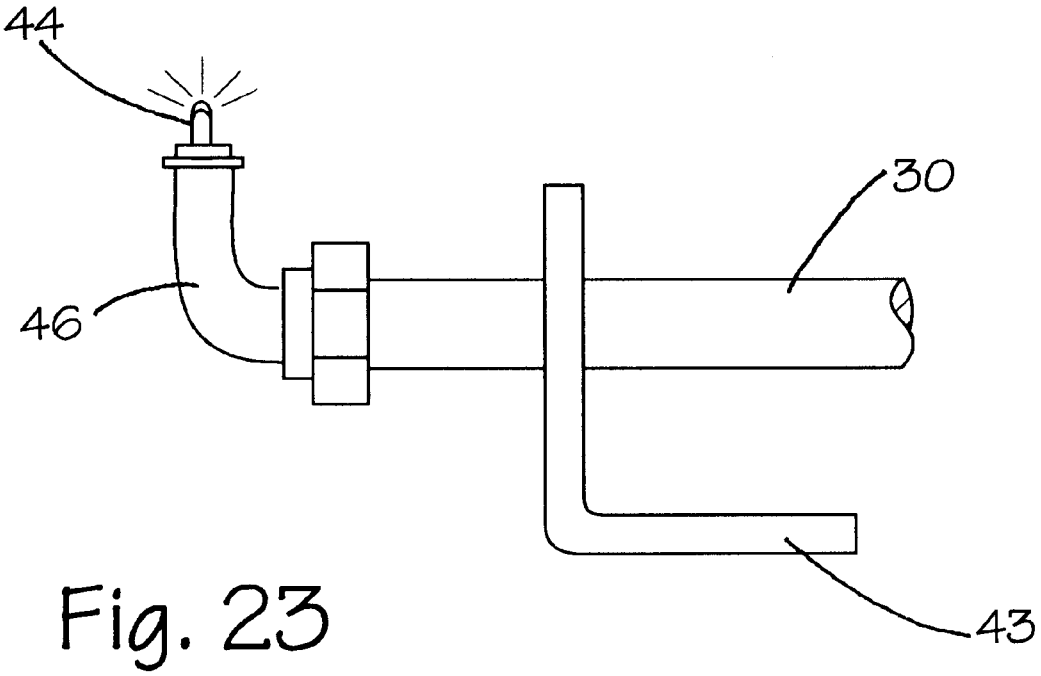
FIG. 23 is a schematic fragmentary elevational view of a skid mounted end of the nozzle pipe.

FIG. 5 shows the wheel unit 42 that includes a center saddle clamped to the nozzle pipe section 30 with U-bolts so that the wheel unit can be relocated if desired. The saddle holds an axle at right angles to the nozzle pipe section 30 of the required length to be supported by the wheels. As shown in FIG. 23, skids 43 may also be utilized to support the inby end 29 of the nozzle pipe section 30 for movement in the mine floor.

FIG. 6 shows an extensible telescoping support 60 that raises a nozzle or nozzles mounted on the top thereof to an elevated position. The support is designed so that the water pressure extends the support. The collapsed position reduces the size of the opening 22 needed to put the nozzle pipe section 30 through the stopping 20.

Referring to FIG. 7 there is illustrated a hinged support 62 folded down so that it can pass through the opening 22 in the stopping 20. When through the opening 22, the support 62 is raised manually to a vertical operating position. While it is not shown, the support 62 can be fitted with a spring operable to raise and hold the support in a vertical position. A latch capable of being released remotely holds down the support 62. The release is a short cable operated after the support is clear of the stopping. The release can also be a long cable that is used after the nozzle pipe section 30 is in position.

Figure 22:
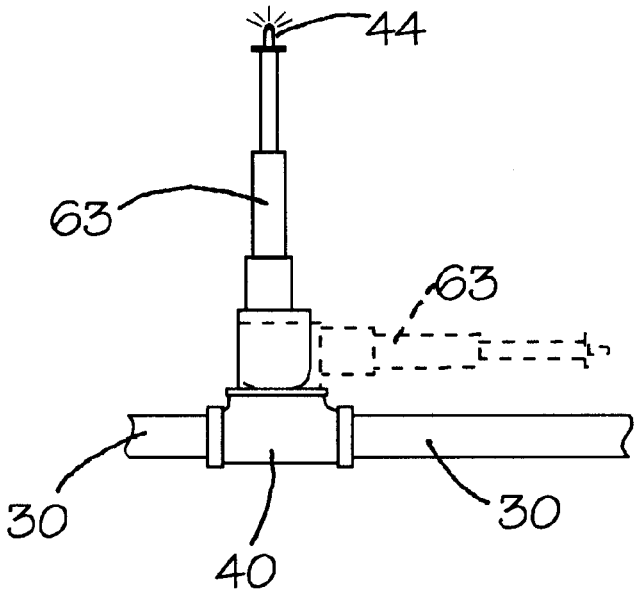
FIG. 22 is a view similar to FIGS. 6 and 7, illustrating an elevated telescoping nozzle supported by a hinged mount that is pivoted from a horizontal position, either manually or by the use of a spring.

Referring to FIG. 22 there is illustrated a nozzle exhibiting the characteristics of both FIGS. 6 and 7. A hinged extensible telescoping support 63 is provided which is operable to raise a nozzle mounted on the top thereof to an elevated position. The support is designed so that depending upon the size of the opening 22 in the stopping 20, the support may either by folded down or retracted. If the support 63 is merely retracted, the water pressure extends the support into an operating position. If the support 63 is folded down to pass through the stopping 20, the support is manually raised into position. As discussed above, a spring may be used to allow remote raising and lowering of the support 63.

Figure 8:
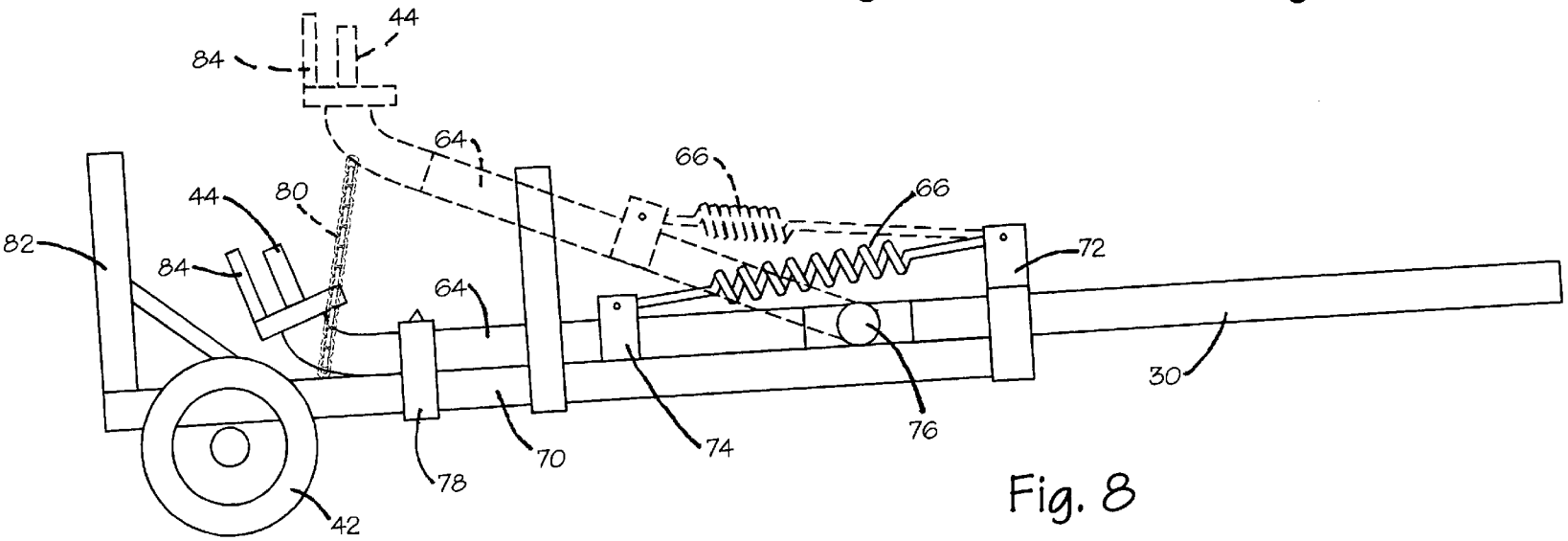
FIG. 8 is a schematic fragmentary elevational view of another embodiment of the wheel mounted end of the nozzle pipe, illustrating a spring mounting for positioning a nozzle assembly in an elevated position upon release of the cable operated latch.

Referring to FIG. 8 there is illustrated another method of placing a nozzle 44 or a number of them in an elevated position so that the nozzles can provide a water curtain on the other side of a barrier that cannot be penetrated reliably. Typically, a conveyor belt structure 52 is supported by legs, as shown in FIG. 4, and presents a barrier that the nozzle pipe assembly 30 may not penetrate. Withdrawing a large portion of the piping and redirecting it may not be successful as the path that the wheels 42 takes cannot be accurately controlled nor can the path be seen because of the smoke. Also, some belts and especially those that are used in mines having thinner coal seams may not have sufficient height beneath the belt structure to allow the nozzle pipe section 30 to pass. The apparatus shown in FIG. 10 is built so that one or more nozzles are positioned to create the water barrier beyond the physical barrier.

The main structural member 70 is a channel or a pair of angles to which the nozzle pipe section 30 is attached. The bottom end of the elevating pipe 64 is hinged to the end of the nozzle pipe section 30 with a swivel 76 that feeds the water flow to the elevating pipe. In an alternative embodiment the elevating pipe is hinged from the structural member 70 and connects the nozzle pipe section 30 to the elevating pipe 64 with a suitable length of stainless steel metal hose.

Further as shown in FIG. 8 the end of the elevating pipe 64 does not extend as far at the structural member 70. It can be as close as a few inches from the end. At the end of the structural member, a vertical member 82 is attached so that it abuts or engages any part of the belt structure 52 and prevents the assembly from passing under the belt structure and possibly preventing the elevating pipe from rising to the desired position. The vertical member 82 is not shown as being hinged and spring loaded but it should be understood that such an arrangement can be used to operate the vertical member 82.

Figure 9:
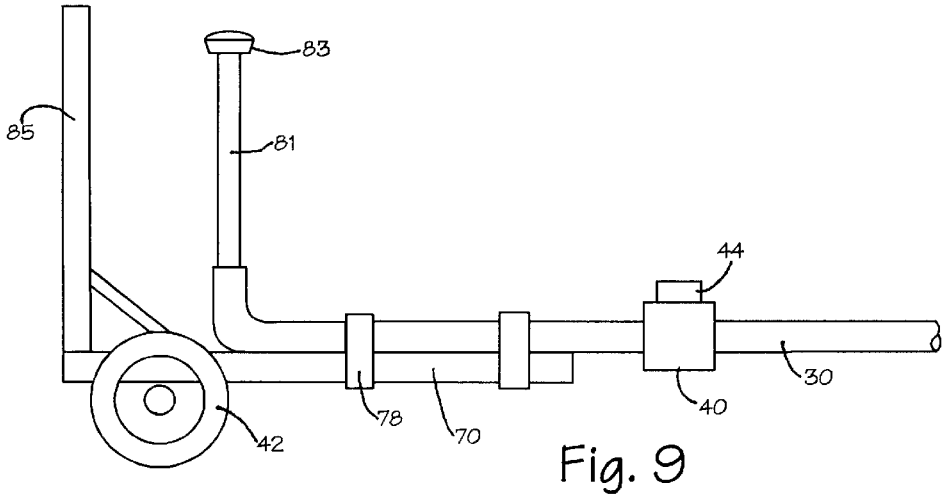
FIG. 9 is a view similar to FIG. 8, illustrating the wheel mounted end of the nozzle pipe having an upwardly projecting guard positioned forward of the wheels for abutting an obstruction in the mine entry.

Referring to FIG. 9, there is illustrated the inby end 29 of the nozzle pipe section 30 having an elevated pipe section 81 with a selected nozzle 83 attached thereto. The nozzle pipe section 30 is movably supported by the wheel unit 42. Extending outwardly and upwardly from the wheel unit 42 and pipe section 81 is a guard or bumper device 85 for stopping the nozzle pipe section 30 when it contacts an obstruction, such as the conveyor shown in FIG. 10 or the opposite mine sidewall or rib. Preferably the bumper device 85 extends in height above the elevated nozzle 83.

As shown in FIG. 10, when the inby end 29 of the nozzle pipe section 30 is advanced in the entry to the position where the bumper device 85 contacts the conveyor belt 52 further movement of the nozzle pipe section 30 across the entry is obstructed. The nozzle pipe section 30 cannot advance any further; however, the nozzle 83 on the elevated pipe section 81 is operable to cast a water spray upwardly and over the conveyor belt 52 into contact with the opposite sidewall and overhead into contact with the mine roof. Thus a continuous water curtain is established the entire width and height of the entry even though the nozzle pipe section 30 is only advanced partially across the entry and not to the opposite sidewall.

Figure 11:
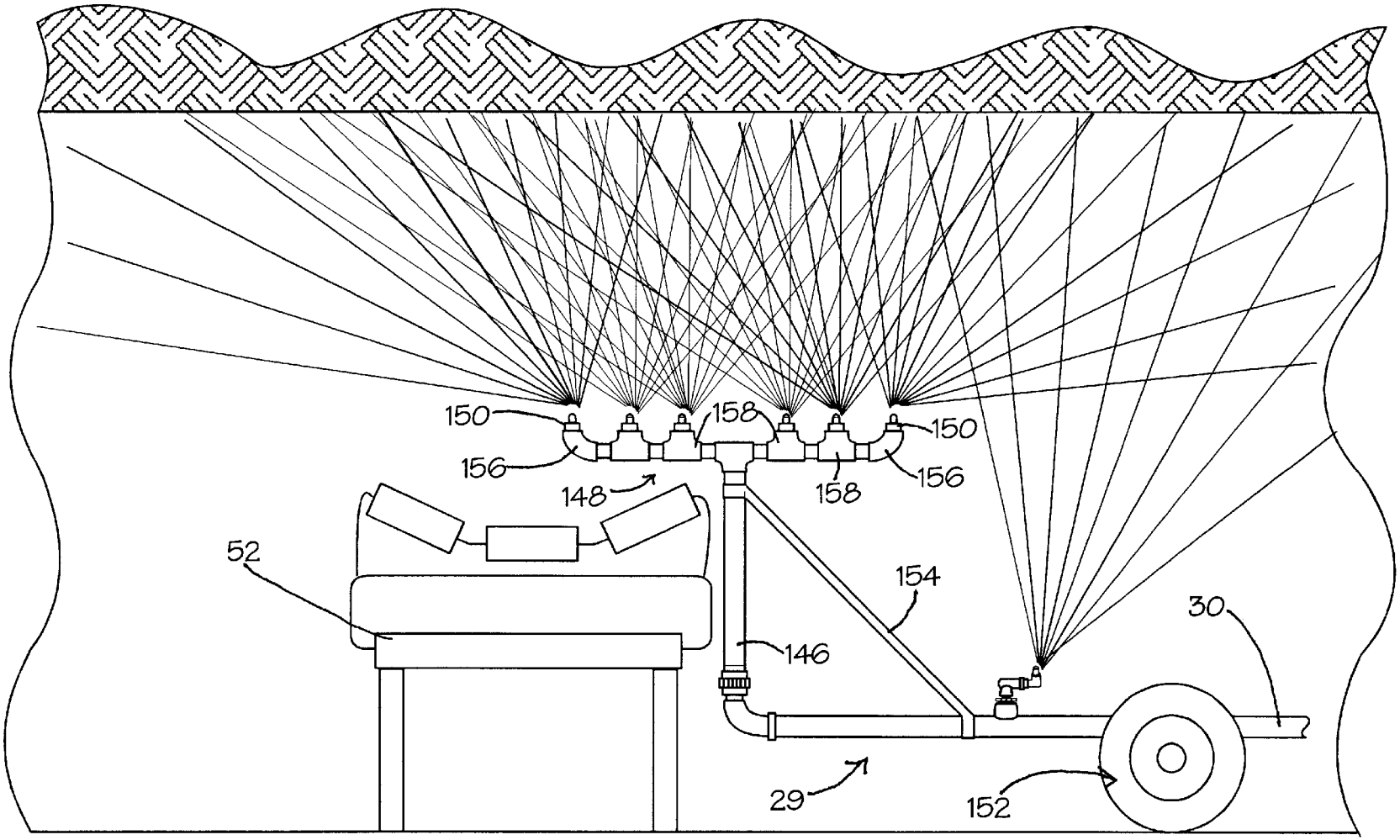
FIG. 11 is a view similar to FIG. 9, illustrating another embodiment of a nozzle pipe having an array of elevated nozzles for casting a spray above an obstruction, such as a conveyor, in the entry.

Referring to FIG. 11, there is illustrated the inby end 29 of the nozzle pipe section 30 having an elevated pipe section 146 with an array 148 of nozzles 150 attached thereto. The nozzle pipe section 30 is movably supported by a wheel assembly 152 positioned upstream of the elevated pipe section 146. An angle brace 154 is positioned between the elevated pipe section 146 and the nozzle pipe section 30 to support the elevated pipe section 146 when it contacts an obstruction located in an intermediate portion of the entry, such as a conveyor as shown in FIG. 11.

The nozzles 150 on array 148 are mounted in a variety of fashions. End nozzles 150 are mounted in elbow-shaped fittings 156 and may be positioned in any angular direction to cast a spray of water either toward the advancing fire or toward the mine roof. In a similar fashion, the intermediate nozzles 150 are mounted in T-shaped fittings 158.

When the inby end 29 of the nozzle pipe section 30 is advanced into the entry to the position where the elevated pipe section 146 contacts the conveyor belt 52, further movement of the nozzle pipe section 30 through the entry is halted. Therefore, the nozzle pipe section 30 cannot advance the entire way into the entry. However, the array 148 of nozzles 150 attached to the elevated pipe section 146 extends over the conveyor 52 as shown in FIG. 11. This allows the nozzles 150 to cast a spray of water upwardly and over the conveyor belt 52 into contact with the opposite sidewall and overhead contact with the mine roof. In this manner, a continuous wall or curtain of water is created which covers the entire width and height of the entry even though the nozzle pipe section 30 is only partially advanced across the entry.

Referring to the embodiment shown in FIG. 8 a spring 66 operates the elevating pipe 64. The spring 66 is attached to the structural member by bracket 72 and to the elevating pipe by bracket 74. The tension in the spring 66 raises the elevating pipe 64 when the latch mechanism 78 is released by pulling on a long cable (not shown) that extends back to the water valve 38 at the fire hose 34 end of the piping. An adjustable length of chain 80 is attached between the elevating pipe 64 and the structural member 70 so that the rise of the pipe can be set. An alternative to the chain and also a backup in event the chain is improperly set is a rod 84 of fixed length that is attached to the nozzle end of the elevating pipe 64 and projects beyond the nozzle 44 so that the nozzle does not impact or get too close to the roof 17.

In accordance with the present invention, the inby end 29 of the nozzle pipe section 30 within the entry 12 is threaded so fittings or a cap can be attached. The outby end 33 or opposite end of the nozzle pipe section 30 in the crosscut 14 is threaded or grooved so that an extension pipe can be coupled rapidly to it. The wheel unit 42 is provided with a saddle or the like (not shown in FIG. 5) which is clamped to the bottom of the nozzle pipe section 30. An axle with wheels 42 or skids 43 is attached to the saddle so that the wheels or skids will support the nozzle pipe section 30 and allow nozzle pipe section 30 to be moved and positioned. Additional lengths of extension pipes can be coupled together as needed to lengthen the assembled run of pipe.

If required, additional wheel units 42 can be attached to one or more extension pipes 32, shown in FIGS. 1 and 2, so that the entire length of the pipes can be moved by the available personnel. The extension pipes 32 are connected to the nozzle pipe section 30 by threaded or groove type couplings 36 as shown in FIGS. 3 and 4. When the last length of extension pipe 32 is attached to the nozzle pipe section 30, a short coupling pipe 39 (FIG. 2) having a shutoff valve 38 and a hose coupling is connected at the outby end 33 of the nozzle pipe section 30 to the open end of the extension pipe 32 so that the fire hose 34 can be attached to supply water to the assembled pipe sections.

The nozzle pipe section 30 includes a number of threaded fittings to which additional pipe, pipe fittings, or nozzles are attached. Because of the variety of situations that exist from mine to mine and even within the same mine, it is possible that several nozzle pipes may have to be kept with each cache of fire fighting equipment. The differences within individual entries can include the presence or absence of a belt conveyor. Some belt conveyors are supported from the bottom, while others are held within chains from roof bolts; and other entries have a mine car rail track. Fortunately, with a few pipe fittings and a supply of different styles and models of nozzles a preselected spray pattern is generated to obtain an effective water curtain in the mine entry. The nozzles are adjustable on the pipe fittings to provide a spray pattern of a preselected angle in a range of angles between about 0° to 90°.

Figure 24:
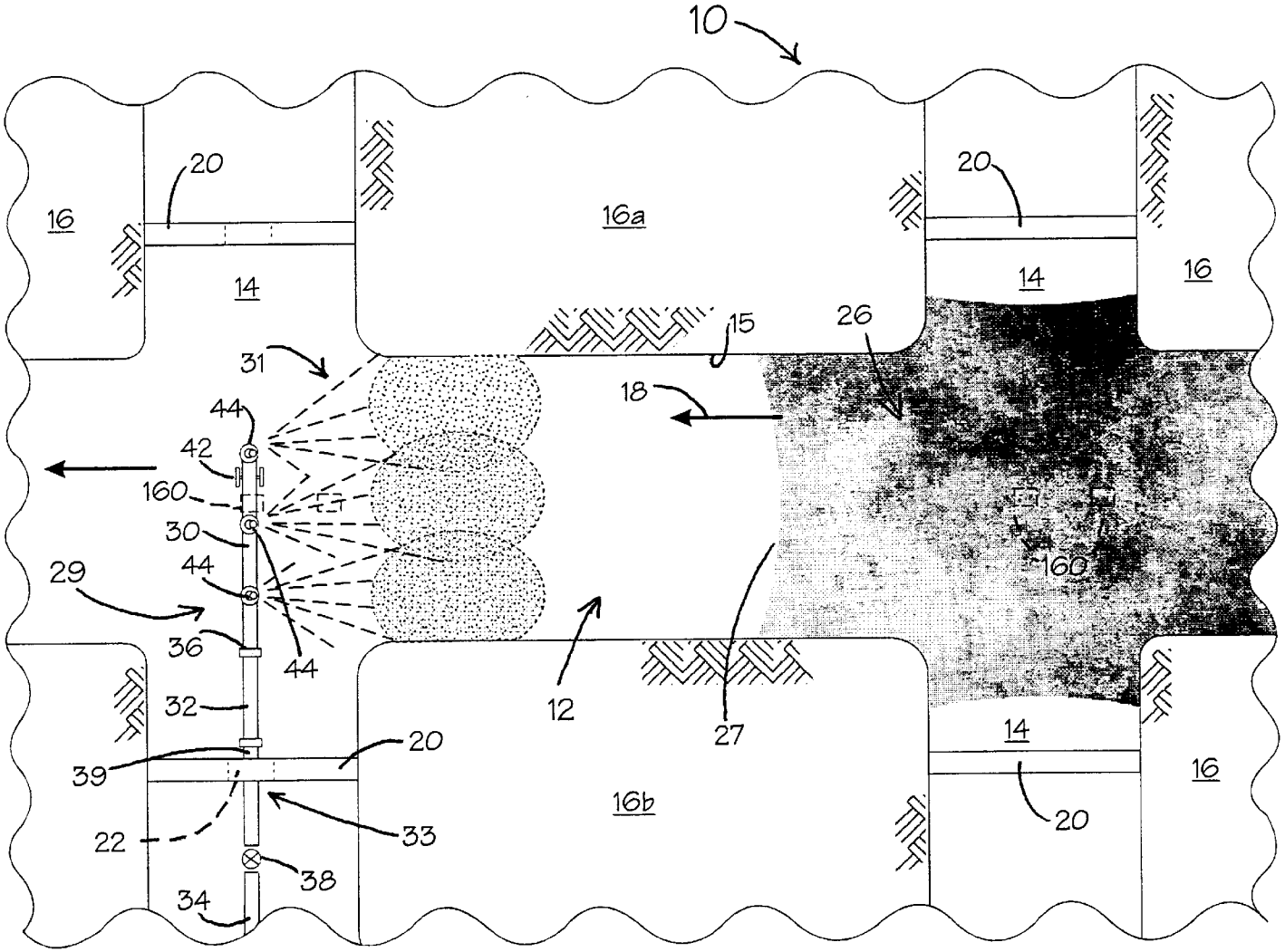
FIG. 24 is a plan view of the mine layout similar to that shown in FIG. 2, schematically illustrating the layout of spads used to identify the position of the nozzle pipe in the mine entry.

Usually the entries are driven on sights from spads 160, as shown in FIG. 24. The spads 160 are set by the engineers so the spacing of the entry centerlines are accurate. With the pipes cut accurately, it is easy to measure and determine where the nozzles are in the fire entry.

If the crosscut between the fire entry and the parallel entry of access has a stopping, a hole is made in the stopping and the nozzle pipe section is 30 inserted through the hole. Usually only one in five stoppings has a man door. The man door is used if it is in the crosscut where the equipment is to be placed. Extension pipes are added, as needed, at the outby end 33 of the nozzle pipe section 30. The pipe assembly is then pushed through the crosscut to the desired point.

If the fire entry is not a belt entry, tests show that simple combinations of nozzles provide an effective water barrier. If a belt is present, a vertical member, such as the bumper or guard 85 shown in FIG. 10, is clamped to the nozzle pipe section 30. With this arrangement, movement of the nozzle pipe section 30 in the mine entry is obstructed when the guard 85 contacts the side of the belt structure putting the elevated pipe section 81 and nozzle 83 in position for filling the entry with a water curtain its full height and width.

Tests prove that it is advisable to test the spray pattern generated by the various models of nozzles mounted on the fittings of the nozzle pipe section 30, especially in the entries where conveyor belts or other obstructions were located. If the desired spray pattern is not generated, adjustments to the nozzles are made or one model nozzle is replaced with another model on the nozzle pipe section 30. The fittings for the nozzles allow a wide range of nozzle styles and models to be interchanged on the nozzle pipe section 30. Often moving the nozzle from one fitting to another, changing its direction by installing or adjusting a ball fitting, or installing a different nozzle easily changes the spray pattern to the desired configuration.

Further, in accordance with the present invention, when making a hole in a stopping or opening the man door, the air flow through the hole or door may put smoke and heat onto the firefighters if the air pressure in the fire entry is greater. The pressure on the firefighters' side can usually be increased by hanging a check curtain further inby in the parallel entry. When water is flowing to the nozzles, the hole or door can be reasonably sealed by covering the opening with brattice cloth or other material.

If it is safe and possible, the temperature in the fire entry inby the water curtain made by the nozzles should be checked. The water sprays do not eliminate the smoke, but they do lower the gas temperature considerably. The lowered temperature may still be too hot for personnel. Reduced temperatures are a positive indication that the water sprays are effective.

If the crosscut does not have a stopping, there should not be any problem in establishing the water curtain. With an open crosscut, usually there will be a greater length of extension pipes 32 to push through the entry. Since the nozzle pipe need not be larger than 2 inches, even if the water system pressure is marginal, 100 feet of nozzle pipe usually is not too difficult for three or four firefighters to push. However, with some bottom conditions, it may be necessary to attach additional wheel assemblies to extension pipes to move the long pipe assembly.

Since smoke and heat from the fire may flow through the crosscut to the parallel entry, a check curtain should be placed in the parallel entry inby the crosscut. This will force the air moving in the parallel entry into the crosscut which should stop or reduce the heat and smoke. If this is not effective, a check should be put in the crosscut. If both of these methods are not adequate, then the air flow outby the fire and outby the parallel entry should be adjusted to supply more air into the parallel entry. Care should be exercised in this method as only a limited amount of air should be taken from the fire entry and from the firefighters working in that entry.

Sometimes a crosscut without a stopping, leading to the fire entry, can develop an active fire moving toward the parallel entry. If it is not safe to control this lateral fire by direct application of water with a fire hose, preferably another water curtain pipe is set up with the spray pattern at right angles to the pipe instead of the normal pattern which is parallel to the pipe. The water curtain should not have any problem as a lateral moving fire is usually not as active as a fire that is moving with the air current.

As discussed above, preferably safety personnel or others test the nozzle pipe section 30, in typical, actual locations to assure that an adequate water curtain is formed in an entry. The easiest test can be carried out at an entry-crosscut intersection without any obstruction. Where obstructions exist, it may be necessary to develop more than one arrangement as the obstructions can be substantially different. After each arrangement is tested, the nozzle pipe section 30 should also be tested to determine if it operates satisfactorily. Each arrangement should be measured to determine the distance from the centerline of the entry to the center of the coupling that joins the nozzle pipe section 30 to the first extension pipe 32. All the nozzle pipes should be marked with the distance measured for the desired arrangement.

Sometimes the conveyor belts, which are the major obstructions encountered, are located to one side of the centerline of the entry or, if this is normal, at an unusual distance from the normal. Where this exists there should be a record made of the deviation and noted on a mine map. The water barrier method to stop the spread of the fire downwind is initiated after active fire fighting with hoses has been established on the upwind side of the fire. There will be time to review the data and mine map to determine if the normal location of the nozzle pipe must be adjusted for any noted deviation.

When the water spray barrier is established in the proper location and with an adequate rate of water usage, the water curtain or barrier stops further spread of the fire downwind. With the spread of the fire stopped, fire fighting first started at the upwind side of the fire will be effective to extinguish the fire.

The method and apparatus of the present invention enables the water barrier to be established without exposing personnel to the terrible heat and smoke that are at the downwind side of the fire. The equipment is inexpensive and little training of personnel is required.

Figure 12:
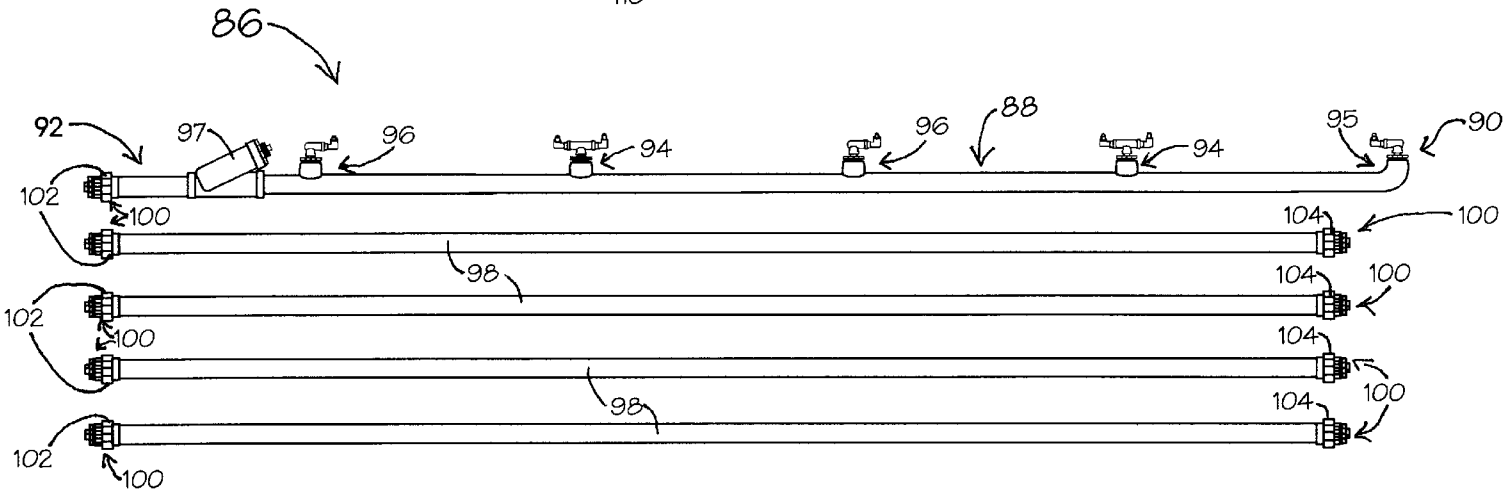
FIG. 12 is a plan view of the disassembled sections of the pipe assembly of the present invention.

Referring to the embodiment shown in FIGS. 12–21 and particularly to FIG. 12, there is illustrated a disassembled water pipe assembly generally designated by the numeral 86 having constituent parts in accordance with the present invention. Water pipe assembly 86 includes a nozzle pipe section 88 having a leading or inby end 90 and a trailing or outby end 92. Nozzle pipe section 88 includes a plurality of nozzle assemblies 94, 95, and 96 operable to receive a flow of water from in the pipe and spray it in preselected directions.

Nozzle pipe section 88 includes a Y-strainer 97 positioned adjacent the outby end 92 to filter out impurities from the water which might otherwise cause blockages in the nozzles. The Y-strainer 97 includes two passageways, one which is connected inline with the longitudinal axis of the nozzle pipe section 88 and a second passageway which extends upwardly at an angle. The upwardly extending passageway includes a tubular strainer. Water flowing through the Y-strainer 97 is directed upwardly through the tubular strainer and into a dead end. The water is then forced around the tubular strainer in the opposite direction and back into the inline passageway of the Y-strainer 97 thereby straining the water flow to remove debris which could possibly cause clogging of the nozzles.

Water pipe 86 also includes a plurality of extension pipes 98. Each extension pipe 98 is of substantially the same length and, depending upon the requirements of the given situation, any number of extension pipes 98 can be connected together with the outby end 92 of the nozzle pipe section 88 to direct a flow of water to the nozzle assemblies 94–96.

The inby and outby ends of each pipe 88, 98 include one half of a conventional rotary union style connector 100. This well known style of connector includes corresponding male and female threaded portions 102 and 104 and permits the pipes to be connected without requiring that the entire length of pipe be rotated. Instead, the female collar 104 is fitted over the male threaded end 102 of the next adjacent pipe and tightened into place.

With the embodiment shown in FIG. 11, the vertical pipe 146 can be quickly and easily attached to the elbow on the inby end of the nozzle pipe using the pipe union 100, shown in FIG. 12. This union can have special keyed or pinned surfaces that accurately orient the male and female sides of the union and accurately orient the position of the vertical pipe 146. Accurate positioning of the vertical pipe 146 ensures proper aim of the fittings 156 and 158 and nozzles 150 at the top end of the pipe so that the sprays cover the conveyor belt 52 and the space above it. Also, the sprays cover the roof and side walls beyond the belt and provide sufficient water to cool the hot gases to prevent spread of the fire.

The vertical pipe 146 can be light enough and sized so that one firefighter can easily insert it through the opening in the stopping. With the inby end of the nozzle pipe section 30 also extending through the opening, the male 102 and female 104 sides of the union are brought into contact and the pipe 146 rotated until the key or pin engage to orient the pipe 148 properly. The two sides of the union are joined by rotating and tightening the nut. This easily assembled arrangement eliminates the necessity of having a firefighter enter the inby side of the stopping. Since the vertical pipe 146 impacts the belt structure 52, as shown in FIG. 11, when it is moved into position, the angle brace 154 stabilizes the vertical pipe 146 and the nozzle pipe 30.

Figure 13:
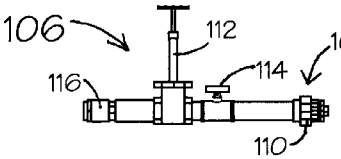
FIG. 13 is a plan view of the fitting and valve assembly for connecting the assembled pipe sections shown in FIG. 12 with a hose from a water source.

Water pipe assembly 86 also includes an external connection fitting generally designated by the numeral 106 in FIG. 13 operable to connect the outby end of the last extension pipe 98 to an external water source (not shown) such as a fire hose. The inby end 108 of the connection segment 106 includes a rotary union member 110 designed to permit easy connection to the outby end of extension pipe 98. The connection segment 106 includes a valve mechanism 112 and gauge 114 for accurately controlling the flow of water into extension pipe 98. The outby end 116 of the connection segment 106 includes suitable means for connecting the water pipe 86 to an external water source.

Figure 14:
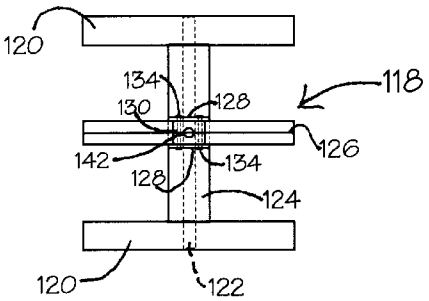
FIG. 14 is a plan view of a wheel unit for supporting the assembled pipe sections for movement into position in the mine.
Figure 16:
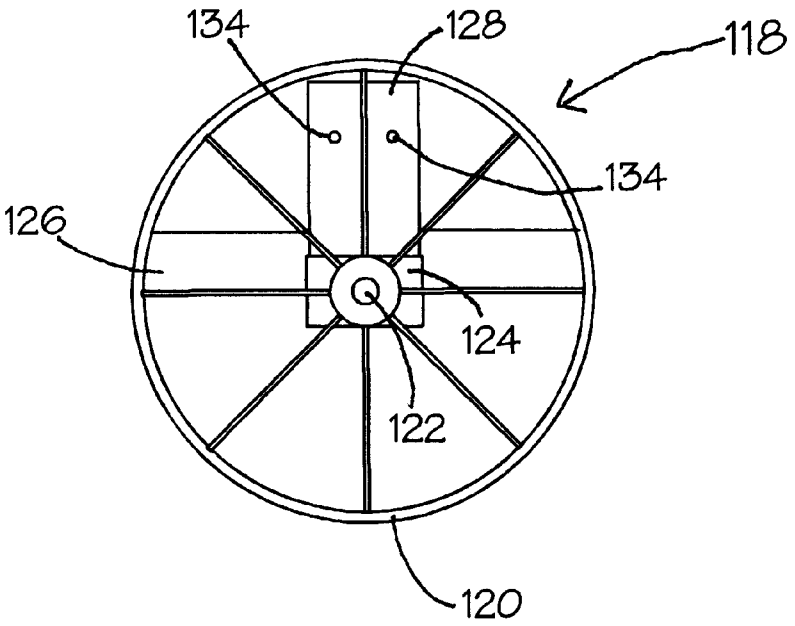
FIG. 16 is an elevational view of the wheel unit shown in FIG. 15.
Figure 15:
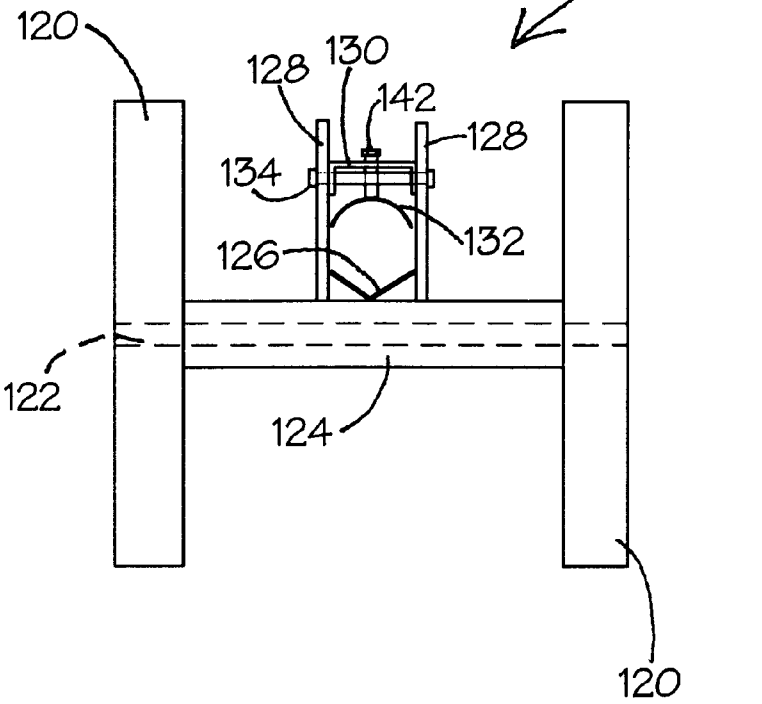
FIG. 15 is an end view of the wheel unit shown in FIG. 14.

Water pipe assembly 86 further includes a wheel unit generally designated by the numeral 118 in FIGS. 14–16. The wheel unit 118 includes a pair of spaced-apart wheels 120 connected by a solid axle 122. A support member 124 is rotatably mounted on the axle 122 between the wheels 120. A V-shaped lower pipe channel 126 is rigidly secured on the support member 124 centered between the wheels 120 and extending parallel to the direction of travel.

A pair of guides 128 are fixedly positioned on the support member 124 on either side of the V-shaped channel 126 and extend upwardly and away from the support member 124. Positioned between the upper portions of guides 128 is an upper plate 130 which includes an adjustable upper pipe channel 132. The upper plate 130 is secured to the guides 128 by a plurality of bolts 134.

Figure 17:
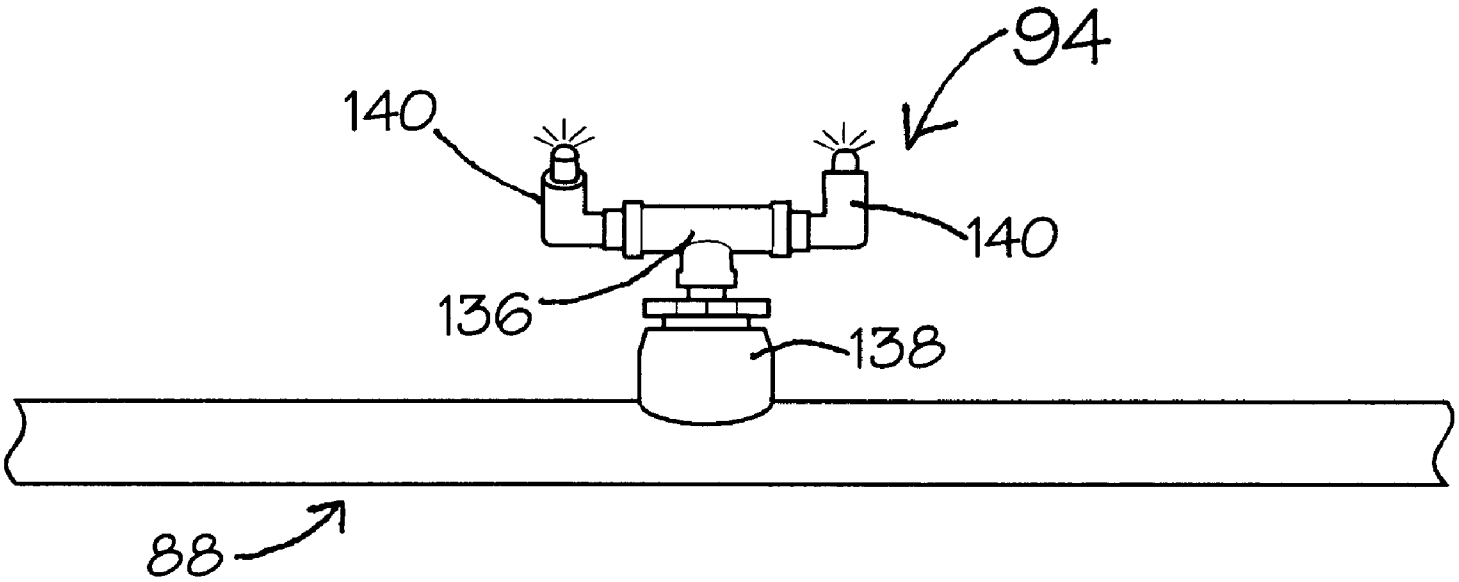
FIG. 17 is a schematic view in side elevation of a section of the nozzle pipe, illustrating a T-shaped elevated fitting having a pair of nozzles attached thereto where one of the nozzles is positioned to cast a spray at an angle of about 45° and another is positioned to cast a spray vertically.

Referring now to FIG. 17 there is illustrated a nozzle assembly 94 mounted to an intermediate portion of the nozzle pipe section 88. Nozzle assembly 94 includes an elevated T-shaped fitting generally designated by the numeral 136. T-shaped fitting 136 is threadedly secured into housing 138 welded to the nozzle pipe assembly 88. Each end of T-shaped fitting 136 is adapted to receive a nozzle 140 at a preselected angle therein. Depending upon the needs of the situation the T-shaped fitting may be provided with a pair of nozzles 140 as shown in FIG. 17, with one nozzle 140 as shown in FIGS. 12, 18, and 19, or with no nozzles.

Figure 18:
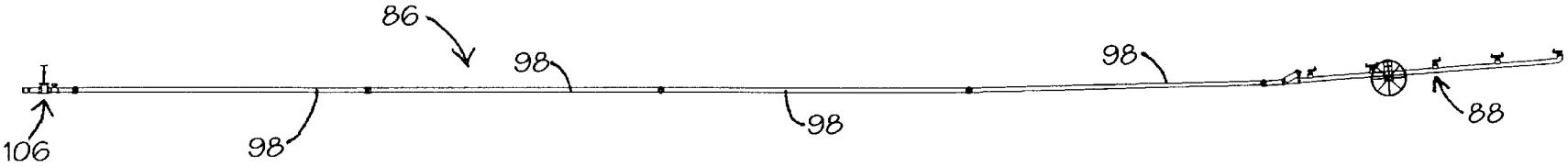
FIG. 18 is schematic elevational view of the wheel mounted assembled water pipe sections shown in FIGS. 12–14.
Figure 19:
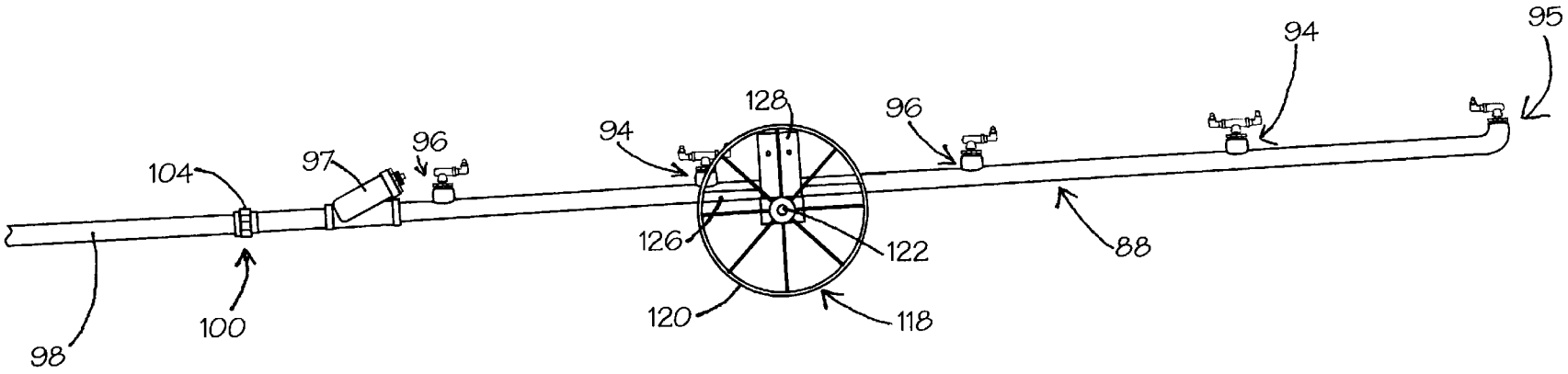
FIG. 19 is an enlarged fragmentary schematic elevational view of the pipe assembly shown in FIG. 18, illustrating the wheel mounted nozzle pipe section of the assembly.

Referring now to FIGS. 18 and 19 there is illustrated an assembled water pipe assembly 86 formed by pipe segments connected by rotary union style connectors as described above. The wheel unit 118 is positioned in an intermediate portion of the nozzle pipe assembly 88 to support the weight of the Y-strainer 96. To attach the wheel assembly to the nozzle pipe assembly 88, bolts 134 and upper plate 130 are removed. The nozzle pipe assembly 88 is lifted over guides 128 and positioned in the V-shaped lower pipe channel 126 at its desired location. At this point, upper plate 130 and bolts 134 are replaced. Upper pipe channel 132 is then tightened into engagement with the nozzle pipe assembly 88 by bolt 142.

In accordance with the present invention, it is often desirable to direct a spray of water not only toward the advancing fire, but also toward the roof bolts which support the mine roof. It is well known in mine roof support systems to use resin bonded roof bolts to support the rock strata above the entry. The tensioned roof bolts are anchored in the rock strata by expansion shells in combination with a quick setting resin surrounding the bolts in bore holes drilled in the mine roof.

If the fire is not extinguished in its early stages, heat from the fire can raise the temperature of the bolts and melt the cured resin resulting in a loss of bolt tension and roof support. Once the roof bolt loses its anchorage, the roof support is lost and the mine roof will probably collapse. The falling roof material could damage the nozzle pipe and destroy the water curtain. Therefore, in accordance with the present invention, several nozzles 140 are positioned to direct a spray of water vertically toward the exposed ends of the roof bolts protruding from the mine roof to keep the bolt ends wet with water. By maintaining the exposed ends of the bolts below an elevated temperature, for example a temperature of 300° F. which is the temperature at which resin manufacturers recommend to prevent the cured resin from softening, the bolts are prevented from transferring heat to the resin around the anchored ends of the bolts. The resin bond between the bolt and the rock strata is maintained, and the mine roof support is not destroyed by the fire in the entry.

Figure 20:
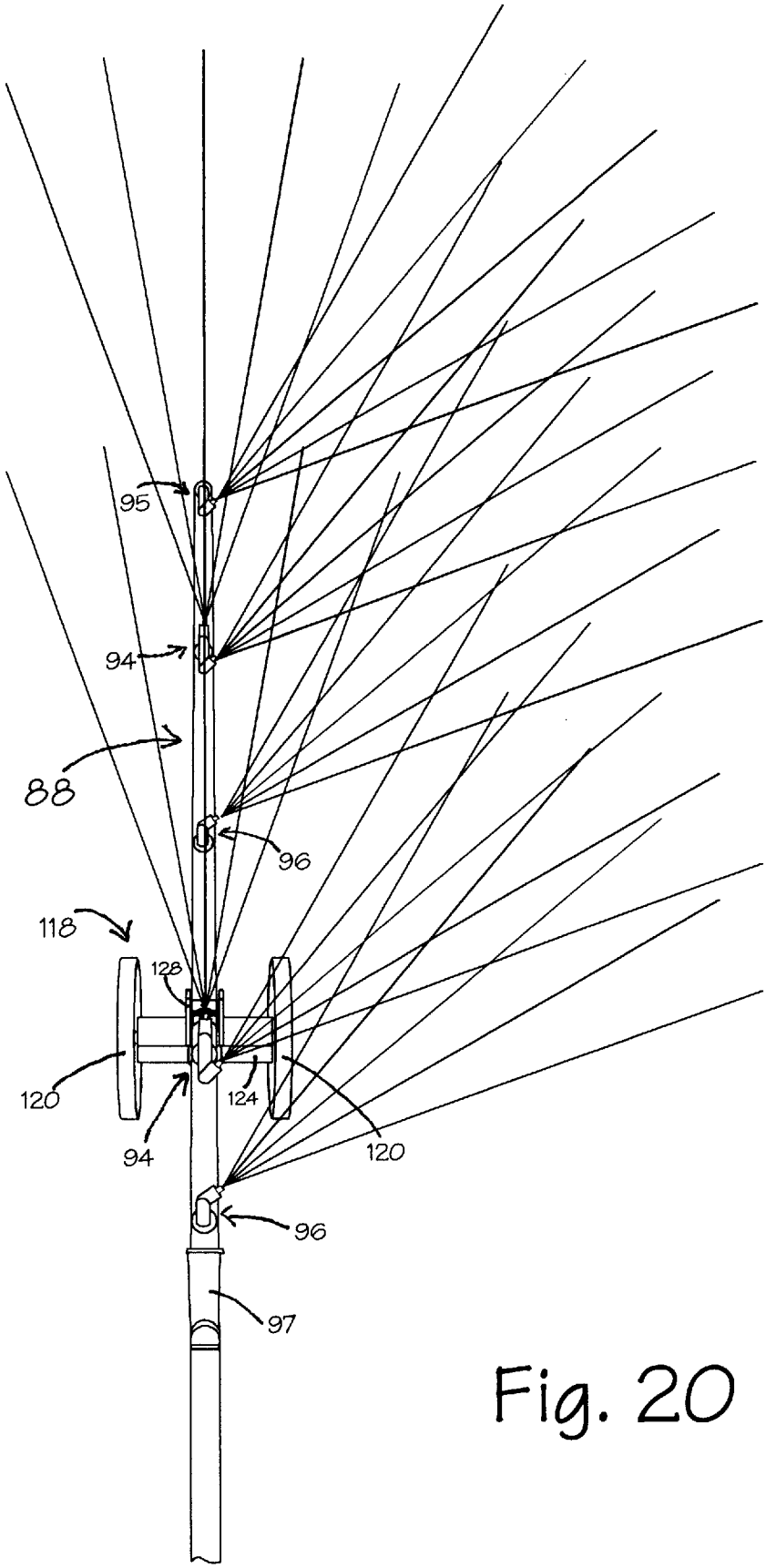
FIG. 20 is a top plan view of the nozzle pipe section in FIG. 19, illustrating a water spray pattern formed by a combination of vertical water sprays and sprays directed at an angle from vertical.
Figure 21:
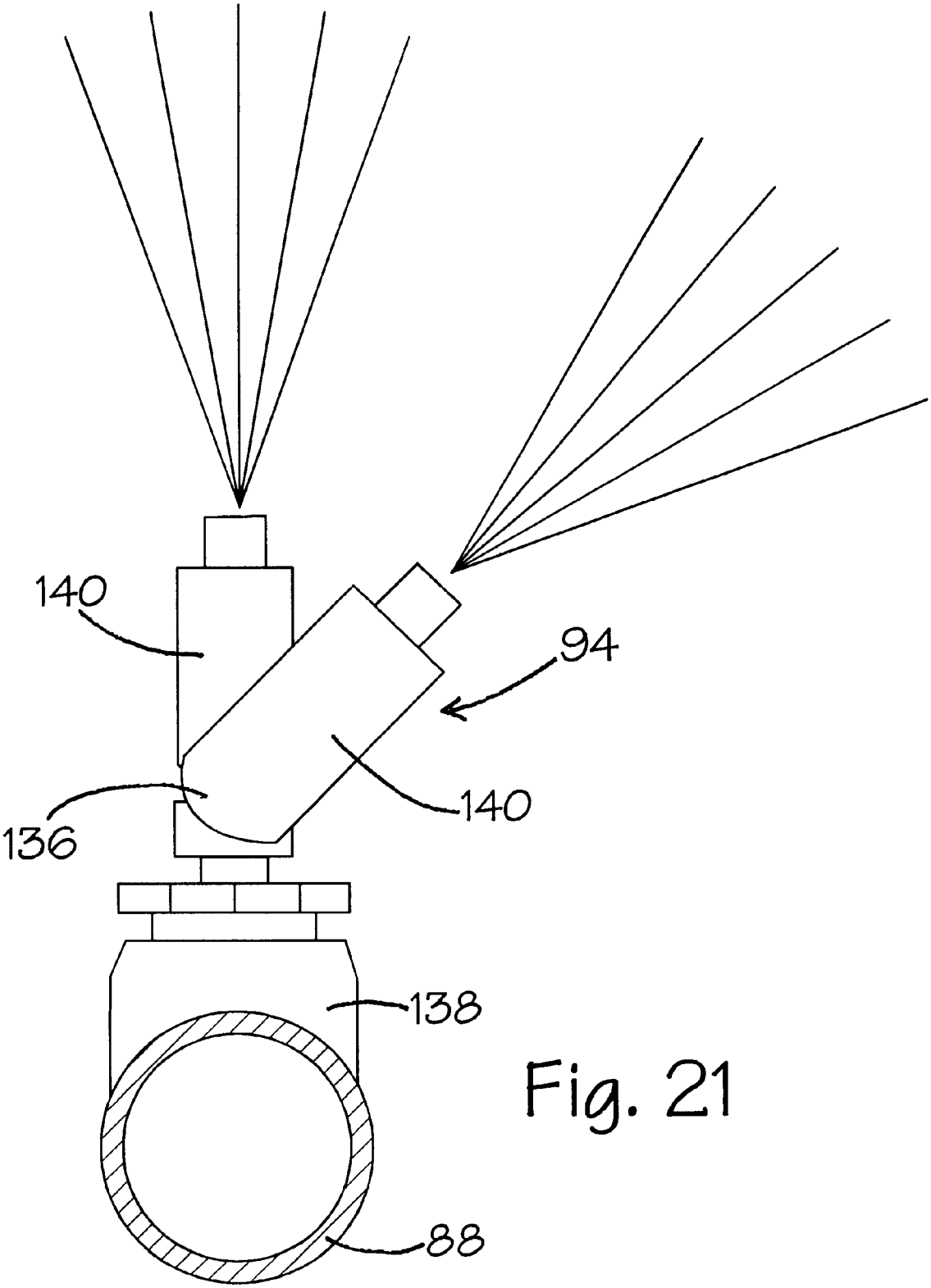
FIG. 21 is an enlarged schematic fragmentary end view of a T-fitting and nozzle combination, illustrating nozzles positioned to cast sprays vertically and at an inclined angle.

Referring now to FIG. 20 and 21 there is illustrated a nozzle pipe section 88 connected by extension pipes to a water source. The nozzles 140 in nozzle assemblies 94–96 emit sprays of water in preselected directions. Preferably, of the seven nozzles 140 illustrated in FIGS. 17, five are directed at a selected inclined angle from the horizontal, such as 45°, and two are directed substantially vertically toward the mine roof.

As shown in FIGS. 20 and 21, the selected relative angles of the spray patterns create two distinct walls of water. One spray pattern is directed toward the fire. The other spray pattern is directed toward the mine roof. As described above, this arrangement provides adequate fire extinguishing properties in advance of the oncoming fire, while maintaining the integrity of the roof support system by keeping the temperature of the mine roof bolts above the nozzle pipe section 88 below a preselected elevated temperature.

According to the provisions of the patent statutes, I have explained the principle, preferred construction, and mode of operation of my invention and have illustrated and described what I now consider its best embodiment. However, it should be understood that within the scope of the appended claims, the invention may be practiced otherwise than as specifically illustrated and described.

I claim:

1. Apparatus for stopping spread of a fire in an underground mine, the apparatus comprising:

a pipe assembly formed of connected pipe sections of preselected lengths for positioning in the underground mine, said pipe assembly having inby and outby opposite end portions, means for supporting said pipe assembly for movement of said inby end portion on a floor of the mine to a preselected position therein, said outby end portion of said pipe assembly being connected to a source of water under pressure to be supplied to said pipe assembly, said pipe assembly inby end portion being a nozzle pipe section having a plurality of outlets extending through a top surface thereof, said outlets being positioned in spaced relation on said nozzle pipe section, and a plurality of spray nozzles connected to said outlets for receiving the pressurized water flowing through said pipe assembly and discharging the water in a spray pattern therefrom, said spray nozzles generating a patterned spray of water projecting upwardly from said nozzle pipe section to form a curtain of water in a preselected orientation to prevent the fire in the underground mine from spreading beyond the curtain of water.

2. Apparatus as set forth in claim 1, in which said pipe assembly directs the pressurized flow of water from said outby end portion to said nozzle pipe section, said preselected lengths of said pipe sections are connected in end-to-end relation to form said pipe assembly, said nozzle pipe section has a plurality of fittings for receiving said spray nozzles, and said fittings are adapted to receive selected types of the spray nozzles to generate a selected water spray pattern in the underground mine.

3. Apparatus as set forth in claim 2, in which said nozzle pipe section located outby of said fittings includes a Y-strainer for filtering out impurities from the pressurized flowing water, and said means for supporting said pipe assembly for movement of said inby end portion includes a wheel unit secured to said nozzle pipe section.

4. Apparatus as set forth in claim 2, in which said selected types of the spray nozzles include a first set of the spray nozzles directed at a selected angle toward the fire and a second set of the spray nozzles directed substantially vertically upwardly toward a mine roof.

5. Apparatus as set forth in claim 2, in which said preselected lengths of said pipe sections are connected in end-to-end relation to facilitate connection and disconnection of said pipe sections.

6. Apparatus as set forth in claim 2, in which said means for supporting said pipe assembly includes a set of wheels secured to said nozzle pipe section.

7. Apparatus as set forth in claim 2, wherein the mine includes a stopping positioned in a crosscut intersecting an entry of the mine, said stopping having a sealable opening, and the apparatus further comprising said pipe assembly extending through said sealable opening from the crosscut into the entry.

8. Apparatus as set forth in claim 7, which further includes means for advancing said pipe assembly inby end portion from the crosscut through said stopping opening to a preselected location in the entry to form the curtain of water extending upwardly and laterally into contact with a mine roof and opposing sidewalls of the entry.

9. Apparatus as set forth in claim 1, in which said means for supporting said pipe assembly includes ground engaging skids for supporting said nozzle pipe section for movement on the mine floor, and said skids are secured to said nozzle pipe section.

10. Apparatus as set forth in claim 1, which further includes means for identifying the position of said nozzle pipe section in a mine entry to move said nozzle pipe section to a position for generating the curtain of water to stop the fire from advancing in the mine beyond the curtain of water.

11. Apparatus as set forth in claim 1, which further includes a vertical member extending upwardly from said nozzle pipe section for engaging an obstruction in the mine to prevent further movement of said nozzle pipe section to a position where said spray nozzles are blocked from generating a desired patterned spray of water.

12. Apparatus as set forth in claim 1, which further includes a telescoping section connecting one of said pipe outlets to one of said spray nozzles for elevating said one of said spray nozzles to a preselected height above said nozzle pipe section.

13. Apparatus as set forth in claim 12, which further includes means for moving said telescoping section between a collapsed position and an elevated position, and one or more of said spray nozzles in the elevated position being capable of casting a spray of water over a barrier obstructing movement of said nozzle pipe section in the mine.

14. Apparatus as set forth in claim 12, which further includes means for hingedly connecting said telescoping section to one of said pipe outlets for selective movement of said one of said spray nozzles between a position coextensive with said inby end portion and a position extending vertically upwardly from said inby end portion.

15. A method for stopping spread of a fire in an underground mine the method comprising the steps of:

advancing a preselected length of a nozzle pipe along a floor of the mine to a preselected position therein, connecting spray nozzles to a plurality of outlets positioned in spaced relation on a section of the nozzle pipe and extending through a top of the nozzle pipe, supplying water under pressure through the nozzle pipe, directing a flow of the water under pressure from the nozzle pipe through the outlets to the spray nozzles, discharging the water under pressure in a spray pattern from the spray nozzles, casting the spray pattern of the water upwardly from the nozzle pipe to form a curtain of water along the length of the nozzle pipe in a preselected orientation, and preventing the fire from spreading in the underground mine beyond the curtain of water.

16. A method as set forth in claim 15, which further includes positioning selected ones of the spray nozzles to direct the spray pattern of the water at a preselected angle toward the fire to stop the spread of the fire, and positioning selected ones of the spray nozzles to direct the spray pattern of the water substantially vertically upwardly into contact with roof bolts anchored in a mine roof to prevent the fire from heating the roof bolts to an elevated temperature.

17. A method as set forth in claim 15, which further includes positioning a strainer upstream of the spray nozzles to filter out impurities in the water which may cause blockages in the spray nozzles.

18. A method as set forth in claim 15, which further includes providing an entry in the mine with a series of intersecting crosscuts positioned a selected distance apart and intersecting the entry, sealing the crosscuts by stoppings positioned in the crosscuts, providing access to the entry from one of the crosscuts through the stopping positioned therein, extending the nozzle pipe from the one crosscut through the stopping positioned therein into the entry, and advancing the nozzle pipe a preselected distance from the stopping in the one crosscut into the entry for positioning the spray nozzles to generate the curtain of water extending a maximum height and width of the entry.

19. A method as set forth in claim 18, which further includes connecting an end of the nozzle pipe positioned in the one crosscut to a coupling, connecting the coupling to a source of the water, locating the coupling in the one crosscut a preselected distance from a centerline of the entry, and connecting the preselected length of the nozzle pipe to the coupling to extend the nozzle pipe from the coupling to position the spray nozzles in the entry for generating the curtain of water the height and width of the entry.

20. A method as set forth in claim 15, which further includes telescopically positioning the spray nozzles on the nozzle pipe, and moving the spray nozzles from a collapsed position on the nozzle pipe to an elevated position on the nozzle pipe.

21. A method as set forth in claim 20, which further includes hingedly connecting the telescopically positioned spray nozzles on the nozzle pipe, and moving the spray nozzles between a collapsed position and an elevated position where the spray nozzles extend vertically upwardly from the nozzle pipe.

22. A method as set forth in claim 15, which further includes providing a series of parallel entries in the mine, connecting the parallel entries by a series of parallel crosscuts, spacing the entries and the crosscuts preselected distances apart, locating the fire advancing in one of the entries, selecting one of the crosscuts positioned ahead of the advancing fire, moving the nozzle pipe and connected spray nozzles from a second of the entries, adjacent to the one entry containing the fire, into the one crosscut ahead of the fire, advancing the nozzle pipe through an opening in a stopping positioned in the one crosscut toward the one entry containing the fire, moving the nozzle pipe from the one crosscut into the one entry containing the fire, and casting the spray pattern of water upwardly from the nozzle pipe to generate the curtain of water to stop the fire from advancing in the one entry.

23. A method as set forth in claim 15, which further includes mounting the nozzle pipe with the pray nozzles on a wheel unit having flanged wheels, and mounting the flanged wheels in the mine on rails of a face conveyor of a longwall mining machine to move the nozzle pipe adjacent to a longwall face in the mine to extinguish the fire on the longwall face.

24. Underground mine fire extinguishing equipment comprising:

an assembled length of pipe sections having inby and outby opposite end portions, said inby end portion including a nozzle pipe section having a plurality of spray nozzles connected thereto in spaced relation longitudinally along said nozzle pipe section, said outby end portion being connected to a source of water under pressure, means for moving said nozzle pipe section to a position extending across an entry of a mine, and said spray nozzles generating a curtain of water directed upwardly from said nozzle pipe section into contact with a mine roof and opposing sidewalls of the mine entry to prevent a fire from spreading in the mine entry beyond the curtain of water.

25. Underground mine fire extinguishing equipment as set forth in claim 24, which further includes a coupling for connecting said pipe sections outby end portion to the source of water under pressure.

26. Underground mine fire extinguishing equipment as set forth in claim 24, which further includes means for supporting said spray nozzles on said nozzle pipe section a preselected height above said nozzle pipe section, and means for moving said spray nozzles between a position closely adjacent to said nozzle pipe section to an elevated position above said nozzle pipe section.

27. Underground mine fire extinguishing equipment as set forth in claim 24, wherein said spray nozzles are positioned on said nozzle pipe section to generate a spray pattern into the mine entry and toward the mine roof at a selected angle.

* * * * *

UNITED STATES PATENT AND TRADEMARK OFFICE

CERTIFICATE OF CORRECTION

PATENT NO. : 5,909,777

DATED : June 8, 1999

INVENTOR(S) : Will B. Jamison

It is certified that error appears in the above-identified patent and that said Letters Patent is hereby corrected as shown below:

Claim 23, column 22, line 15, before "nozzles" delete 'pray' and insert --spray--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*